US008322573B2

(12) United States Patent
Tauber et al.

(10) Patent No.: US 8,322,573 B2
(45) Date of Patent: Dec. 4, 2012

(54) CLOSURE UNIT WITH CAP AND POUR SPOUT FOR CONTAINER NECK FINISH

(75) Inventors: John Tauber, Bel Air, MD (US); Duane Sawyer, York, PA (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 13/204,221

(22) Filed: Aug. 5, 2011

(65) Prior Publication Data

US 2011/0303698 A1 Dec. 15, 2011

Related U.S. Application Data

(62) Division of application No. 11/626,790, filed on Jan. 24, 2007.

(60) Provisional application No. 60/743,172, filed on Jan. 25, 2006, provisional application No. 60/762,886, filed on Jan. 30, 2006, provisional application No. 60/804,535, filed on Jun. 12, 2006.

(51) Int. Cl.
*B67D 1/16* (2006.01)

(52) U.S. Cl. ..... 222/111; 222/569; 222/571

(58) Field of Classification Search ..... 222/109, 222/111, 566, 570, 571, 569
See application file for complete search history.

(56) References Cited

U.S. PATENT DOCUMENTS

| | | | | |
|---|---|---|---|---|
| 3,984,021 | A | | 10/1976 | Uhlig |
| 4,078,700 | A | * | 3/1978 | Hidding ..... 222/109 |
| 4,111,340 | A | | 9/1978 | Greenhow et al. |
| 4,550,862 | A | | 11/1985 | Barker et al. |
| 4,706,829 | A | * | 11/1987 | Li ..... 215/354 |
| 4,830,234 | A | * | 5/1989 | Odet ..... 222/465.1 |
| 4,836,419 | A | | 6/1989 | Metz et al. |
| 4,993,605 | A | * | 2/1991 | Del'Re ..... 222/545 |
| 5,020,682 | A | | 6/1991 | Dutt |
| 5,058,772 | A | | 10/1991 | Moore et al. |
| 5,060,827 | A | | 10/1991 | Segati |
| 5,435,467 | A | | 7/1995 | Ekkert et al. |
| 5,454,476 | A | | 10/1995 | King et al. |
| 5,597,090 | A | * | 1/1997 | Leahy ..... 222/1 |
| 5,855,299 | A | | 1/1999 | Arnold et al. |
| 5,975,322 | A | | 11/1999 | Reid |
| 6,398,076 | B1 | | 6/2002 | Giblin et al. |
| 6,840,405 | B2 | * | 1/2005 | Schneider ..... 222/92 |
| 6,968,980 | B2 | | 11/2005 | Giblin et al. |
| 6,983,862 | B2 | | 1/2006 | Nottingham et al. |
| 2005/0184105 | A1 | | 8/2005 | Johnson |
| 2005/0247744 | A1 | | 11/2005 | Nottingham et al. |

OTHER PUBLICATIONS

International Search Report, International Application No. PCT/US07/61032, mailed Nov. 28, 2007.

* cited by examiner

*Primary Examiner* — Kevin P Shaver
*Assistant Examiner* — Daniel R Shearer
(74) *Attorney, Agent, or Firm* — Barnes & Thornburg LLP

(57) ABSTRACT

A package includes a pour spout and a closure cap. The pour spout is adapted to fit into a neck finish associated with a container using a wedging action.

15 Claims, 35 Drawing Sheets

FIG. 31
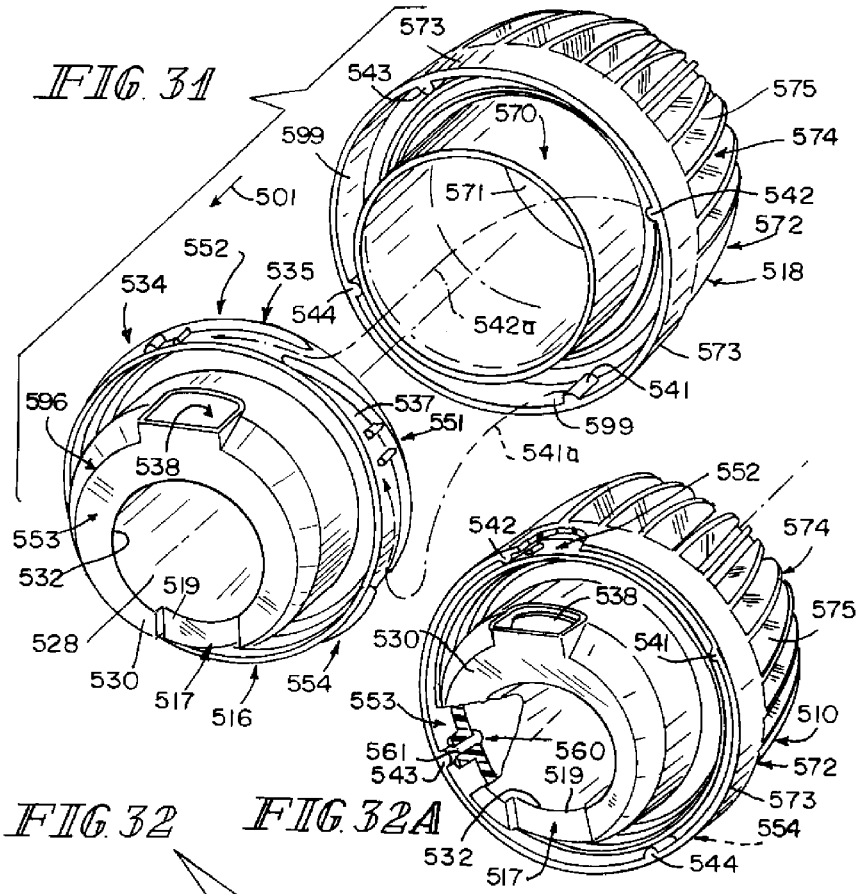
FIG. 32
FIG. 32A
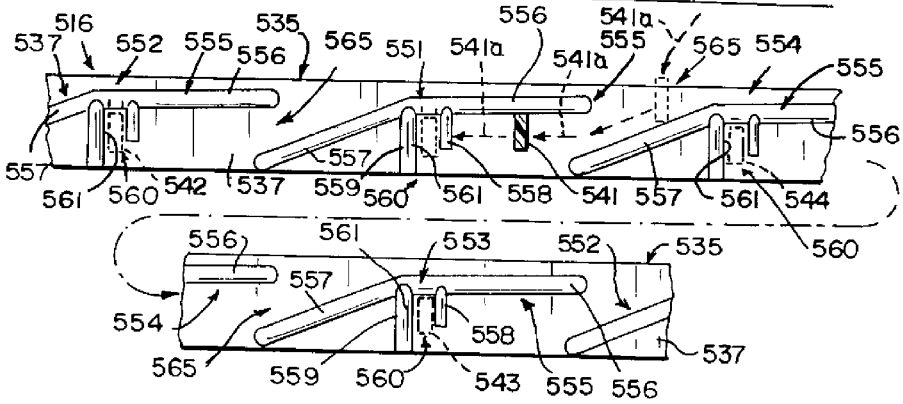

CLOSURE UNIT WITH CAP AND POUR SPOUT FOR CONTAINER NECK FINISH

CROSS-REFERENCE TO RELATED APPLICATIONS

This application is a divisional of U.S. application Ser. No. 11/626,790, filed Jan. 24, 2007, which claims priority under 35 U.S.C. §119(c) to U.S. Provisional Application Ser. No. 60/743,172, filed Jan. 25, 2006; Ser. No. 60/762,886, filed Jan. 30, 2006; and Ser. No. 60/804,535, filed Jun. 12, 2006, which are expressly incorporated by reference herein.

BACKGROUND

The present disclosure relates to a container closure, and particularly to closures for mounting on the top of bottles or other containers. More particularly, the present disclosure relates to closures and pour spouts associated with a bottle or container finish or neck.

SUMMARY

A closure unit comprising a pour spout coupled to a closure cap is preassembled and adapted to be mounted in an opening formed in a neck finish of a container. The closure unit is used in a process for filling a container in accordance with the present disclosure.

In illustrative embodiments, a bottler fills the container using a product dispenser inserted into the opening in the neck finish and then later mounts the preassembled closure unit on the neck finish to close the opening. This causes the pour spout to be anchored to the container yet permits a consumer to remove the closure cap from the anchored pour spout to pour product from the container through a discharge tube provided in the pour spout without separating the pour spout from the container neck finish. The pour spout includes a weir to regulate discharge of fluid material through the discharge tube of the pour spout.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 31 is a perspective view similar to FIG. 30 showing downward movement of the closure cap toward mating engagement with the underlying pour spout to establish the closure unit shown in FIGS. 30 and 32A and showing four circumferentially spaced-apart cap lugs carried on an interior surface of an annular side wall of the cap and suggesting "dotted-line" paths along which two of the four cap lugs will move to reach and mate with cap-lug lock managers included in the pour spout when the closure cap is mated to the pour spout to establish the closure unit;

FIG. 32 is an enlarged "flat development" of an annular rim included in the pour spout showing a series of four spaced-apart cap-lug lock managers provided on an exterior surface of an annular rim of the pour spout and showing that each cap-lug lock manager is configured to include a "ramp-shaped" cap-lug guide rail and two cap-lug retainer ribs extending downwardly from the cap-lug guide rail and showing a "dotted-line" path along which one of the cap lugs moves relative to the pour spout from a "right-side position (shown in phantom) on a steep inclined rail section included in a cap-lug guide rail of one of the cap-lug lock managers first to a "middle" position (shown in section) underlying a gradually sloping rail section included in the cap-lug guide rail of an adjacent cap-lug lock manager and then to a "left-side" position (shown in phantom) engaging a stop face provided on the longer of the two cap-lug retainer ribs to lie in a "trapped" position in a cap-lug receiver defined between the two cap-lug retainer ribs;

FIG. 32A is another view of the preassembled closure unit shown in FIG. 30, with portions broken away, showing one of the cap lugs included in the cap trapped in one of the cap-lug receivers formed between two cap-lug retainer ribs included in a companion cap-lug lock manager included in the pour spout to block relative rotation between the cap and the pour spout about a common axis of rotation;

DETAILED DESCRIPTION

Figure 1:
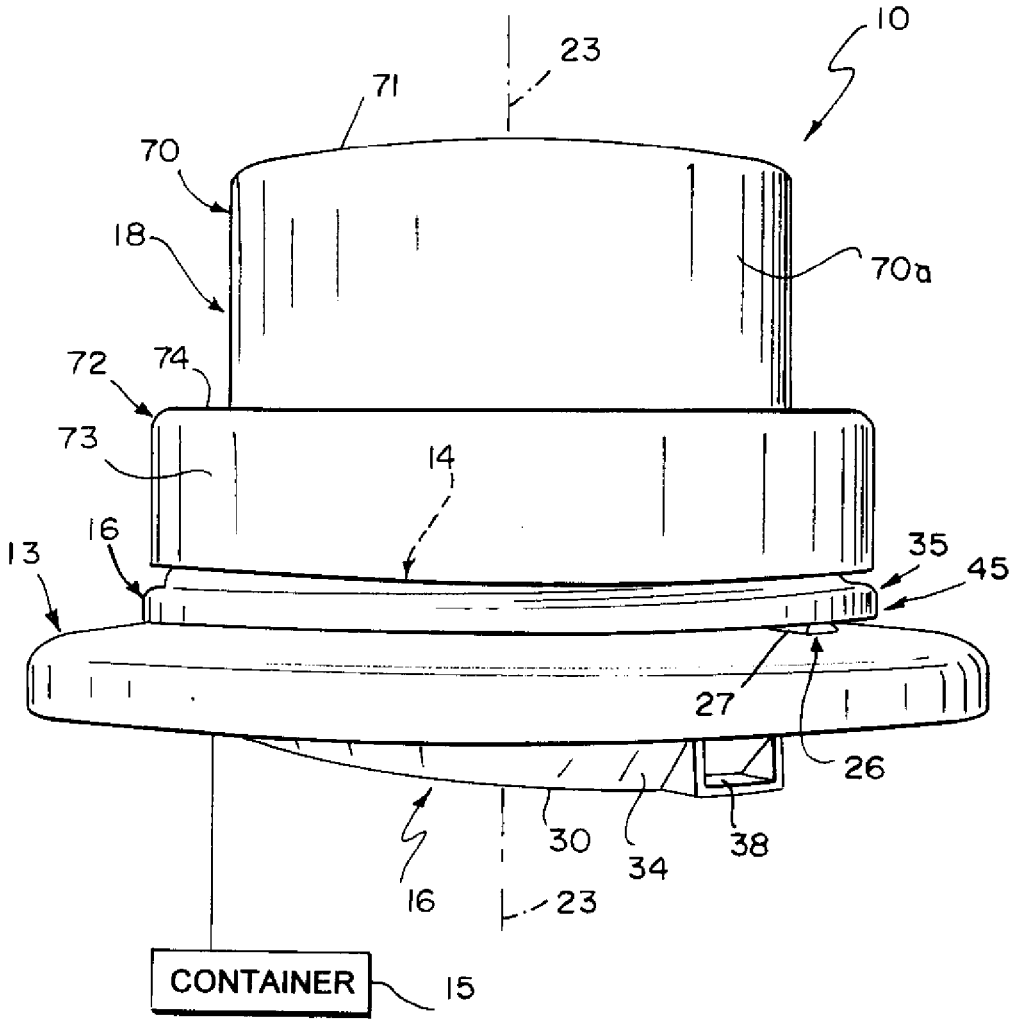
FIG. 1 is a perspective view of a closure unit in accordance with a first embodiment of the present disclosure coupled (for later removal) to a neck finish of a container.

A closure unit comprising a closure cap and a mating pour spout is preassembled at a factory in accordance with the present disclosure and then mounted on a container neck to close a wide-mouth opening into the container after the container has been filled with liquid or solid material. Later, when a customer removes the closure cap to pour the liquid or solid material out of the container (by separating the closure cap from the pour spout), that material flows through a discharge tube included in the pour spout while the pour spout remains anchored in a fixed position on the container neck. An illustrative first closure unit 10 is shown in FIGS. 1-6B; an illustrative second closure unit 210 is shown in FIGS. 7-13; an illustrative third closure unit 310 is shown in FIGS. 14-19; an illustrative fourth closure unit 410 is shown in FIGS. 20-27; and an illustrative fifth closure unit 510 is shown in FIGS. 28-37.

A preassembled closure unit 10 is configured to close "wide-mouth" opening 12 formed in a neck finish 14 provided on a top wall 13 of a container 15 (e.g., bottle) in accordance with a first embodiment of the present disclosure as shown, for example, in FIGS. 1-6. A pour spout 16 is coupled to a closure cap 18 to provide a "preassembled" closure unit 10 shown, for example, in FIG. 3.

Figure 3:
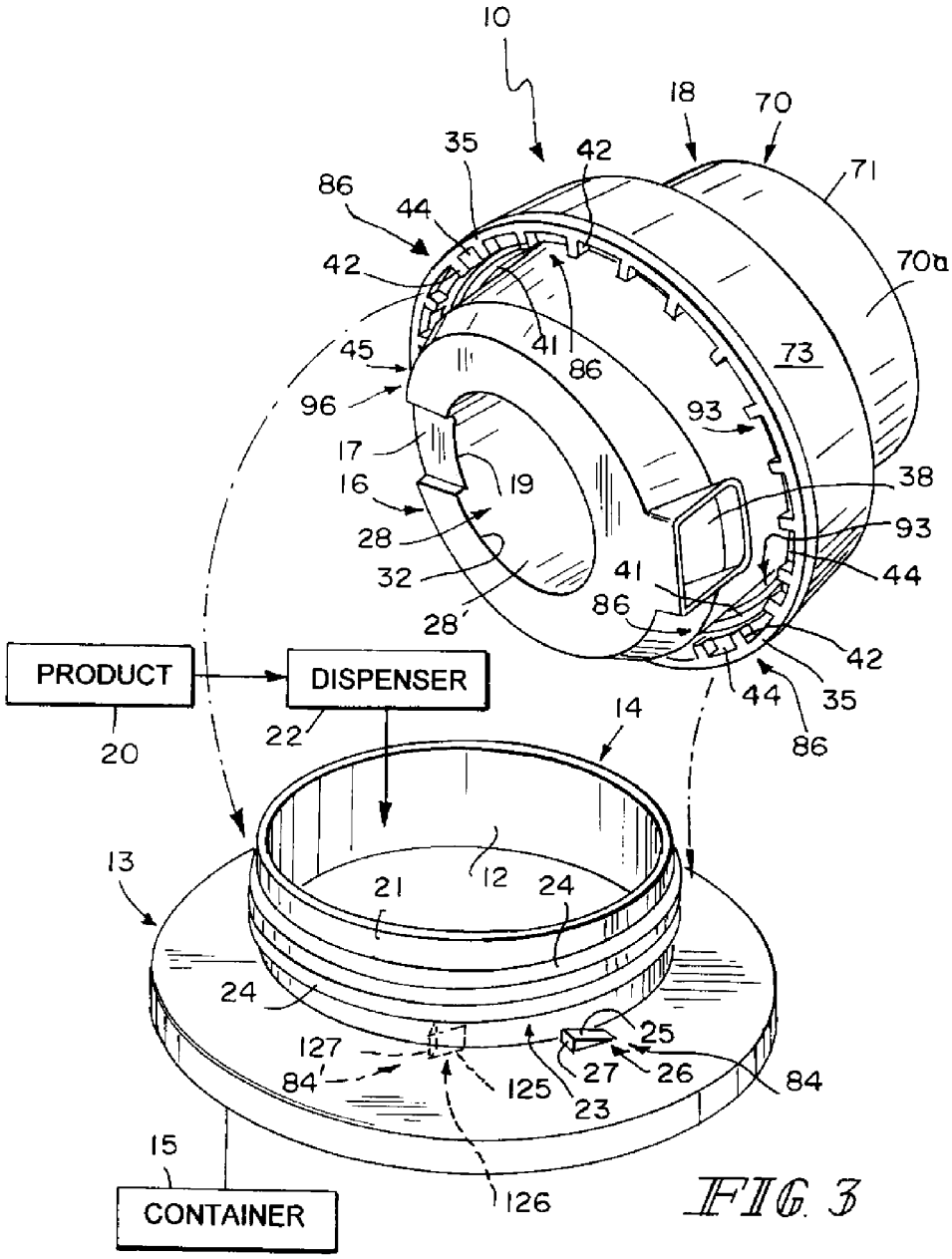
FIG. 3 is an enlarged perspective view showing a preassembled closure unit of the type shown in FIGS. 1 and 2 as it is being installed on the externally threaded neck finish of a container by a bottler after the container has been filled with liquid or other product discharged by a dispenser into the container through a "wide-mouth" opening provided in the container neck finish.
Figures 6A, 6B:
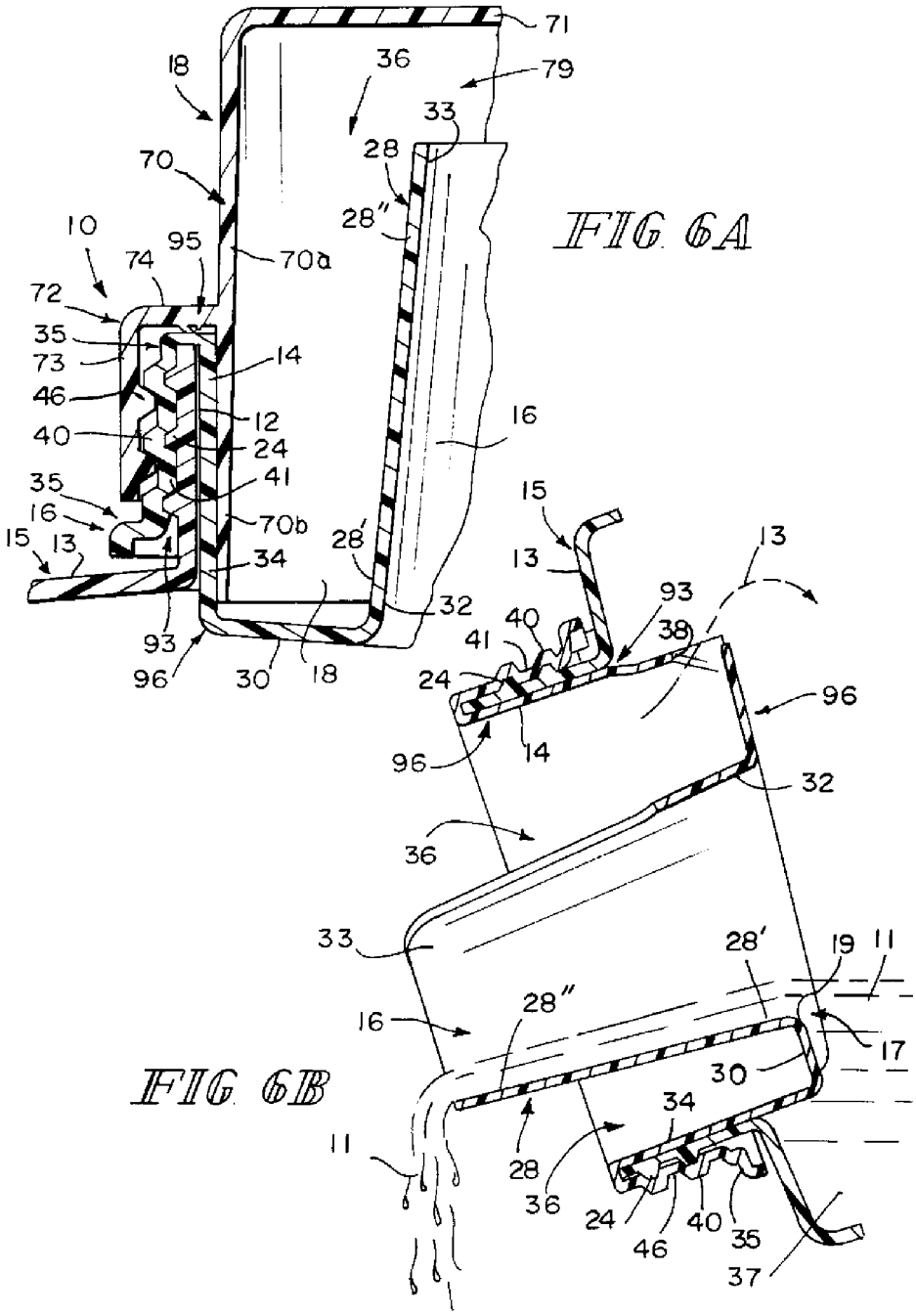
FIG. 6A is a partial sectional view of the components shown in FIGS. 1-5 showing use of a first set of mating threads to couple the pour spout to the surrounding closure cap to form the preassembled closure unit and showing the use of a second set of mating threads to couple the closure unit to the container neck finish along an interface between the container neck finish and the surrounding pour spout.
FIG. 6B is a sectional view similar to FIG. 6A showing discharge of liquid from an interior region of the container through the pour spout (after removal of the closure cap) over a weir included in the pour spout and simultaneous admission of ambient air from the surroundings into the interior region of the container through a product-drainback aperture formed in the pour spout.
Figure 7:
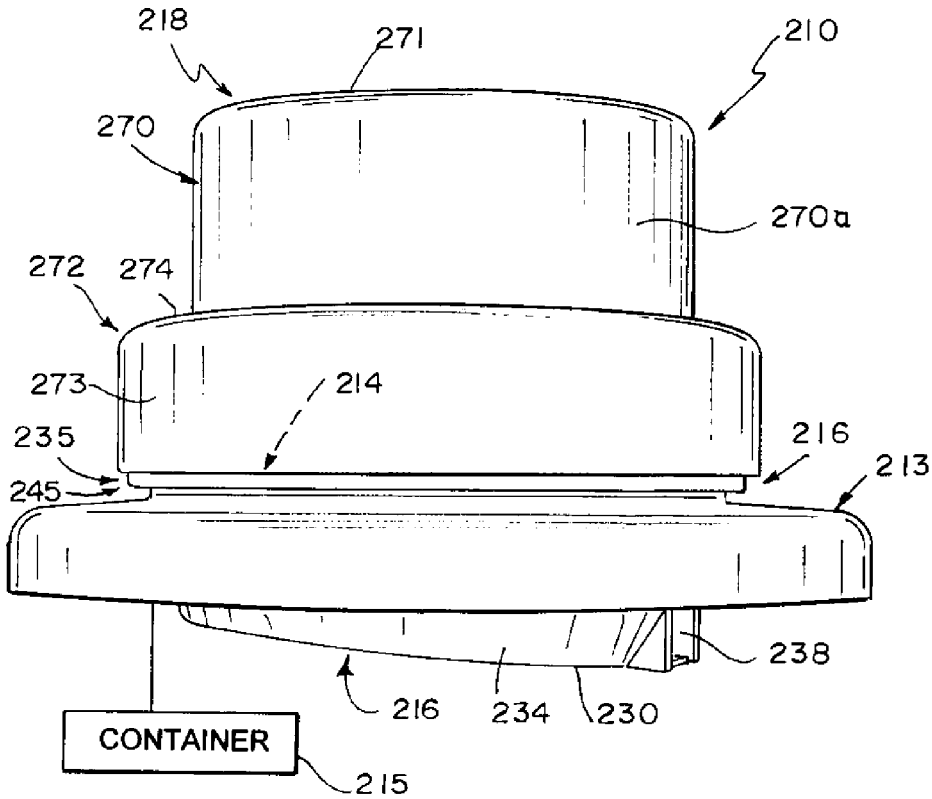
FIG. 7 is a perspective view of a closure unit in accordance with a second embodiment of the present disclosure coupled (for later removal) to a neck finish of a container.

As suggested in FIG. 3, a bottler first discharges product 20 comprising, for example, a fluid material into container 15 through opening 12 using a dispenser 22 and then, after container 15 is filled with product 20, the bottler installs preassembled closure unit 10 on neck finish 14 of container 15 to close opening 12 and anchor pour spout 16 to neck finish 14 as suggested in FIG. 6A. Later, a consumer removes closure cap 18 (by separating closure cap 18 from pour spout 16) to expose pour spout 16 in a stationary, anchored position on neck finish 14 of container 15 as suggested in FIG. 6B. The consumer can then discharge product 20 from container 15 through pour spout 16 over a weir 19 included in pour spout 16. Closure cap 18 can later be remounted on pour spout 16 as desired by a user.

Figure 2:
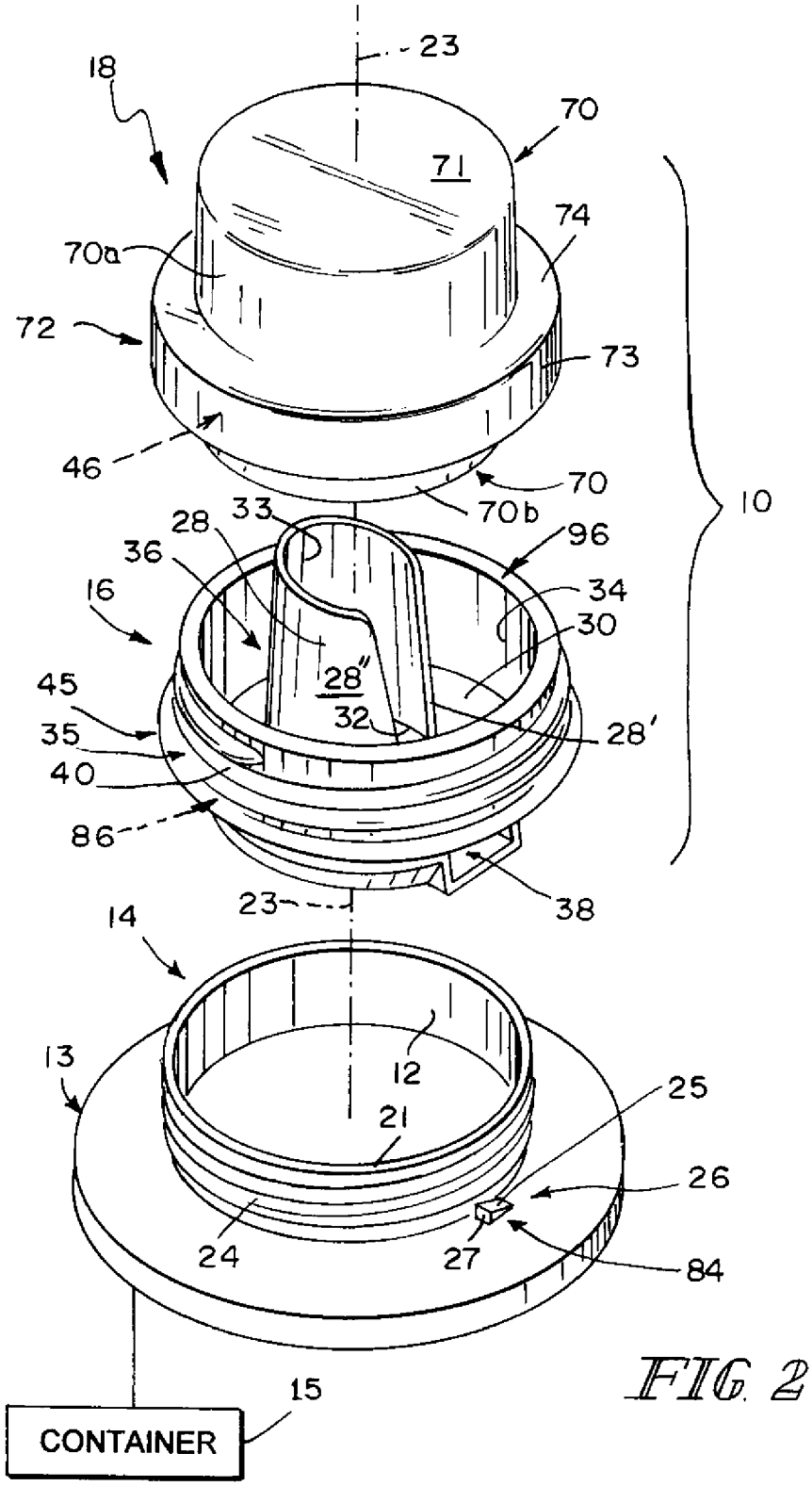
FIG. 2 is an exploded assembly view of the components illustrated in FIG. 1 showing a threaded annular neck finish coupled to a container and a separate (unassembled) closure unit comprising a closure cap and an externally threaded pour spout located between the neck finish and the closure cap and showing an upstanding triangular anti-rotation lug formed on an exterior portion of the neck finish.

Neck finish 14 is ring-shaped as suggested in FIGS. 2 and 3 and is coupled at a lower end thereof to a top wall 13 of container 15. In an illustrative embodiment, container 15 is a monolithic element made of a plastics material and formed to include neck finish 14. Neck finish 14 includes an annular inner surface formed to define opening 12 and sized to receive pour spout 16 therein as suggested in FIGS. 2 and 3. Neck finish 14 includes an annular outer surface 21 formed to include, for example, a single-lead exterior thread 24. It is within the scope of the present disclosure to use multi-lead threads.

Neck finish 14 includes a spout catch retainer 84 (or 84') that is configured to mate with a spout catch 86 included in a finish mount 45 of pour spout 16 to anchor pour spout 16 in a stationary, anchored position on neck finish 14 as suggested in FIGS. 3 and 6A. An anti-rotation lug 26 is included in neck finish 14 and arranged to lie on top wall 13 of container 15 alongside annular outer surface 21 of neck finish 14. It is within the scope of this disclosure to locate anti-rotation lug 26 on top wall 13 in spaced-apart relation to annular outer surface 21 of neck finish 14. In an illustrative embodiment, spout catch retainer 84 comprises exterior thread 24 and anti-rotation lug(s) 26 or 126.

In the illustrated embodiment, anti-rotation lug 26 has a triangular shape and includes an upwardly facing inclined ramp 25 terminating at a vertical stop wall 27 as shown, for example, in FIGS. 2 and 3. In an illustrative embodiment, two anti-rotation lugs 26 are arranged to lie in circumferentially spaced-apart relation to one another about annular outer surface 23 of neck finish 14 and adapted to mate with pour spout 16 to limit rotation of pour spout 16 relative to neck finish 14 as disclosed herein.

In another illustrative embodiment (shown in phantom in FIG. 3), anti-rotation lugs 26 are replaced by anti-rotation lugs 126. Each anti-rotation lug 126 is arranged to lie on annular outer surface 21 of neck finish 14. In the illustrated embodiment, each anti-rotation lug 126 has a triangular shape and includes radially outwardly facing inclined surface 125 terminating at vertical stop wall 127 as shown, for example, in phantom, in FIG. 3. It is also within the scope of this disclosure to relocate anti-rotation lug 126 on top wall 13 of container 15 in the manner described above for lug 26.

Pour spout 16 includes an upright discharge tube 28 and a product drainback cup 96. Upright discharge tube 28 is coupled to a bottom wall 30 of product drainback cup 96 at a fluid-admission 32. Product drainback cup 96 further includes an annular wall 34 coupled to a perimeter edge of bottom wall 30 to form a "product-drainback" reservoir 36 surrounding discharge tube 28. As suggested in FIGS. 2 and 6B, discharge tube 28 is formed to include an inner portion 28' formed to include a fluid-admission inlet 32 arranged to open into an interior region 37 of container 15 and an outer portion 28" formed to include a fluid-discharge outlet 33. Annular wall 34 of pour spout 16 is formed to include a product-drainback aperture 38 communicating with reservoir 36 as shown, for example, in FIGS. 2, 3, 4, and 6B. An outer surface of annular wall 34 is formed, for example, to include a single-lead external thread 40 shown in FIG. 4 and configured to mate with an internal thread 46 included in closure cap 18 as suggested in FIG. 6A.

Figure 4:
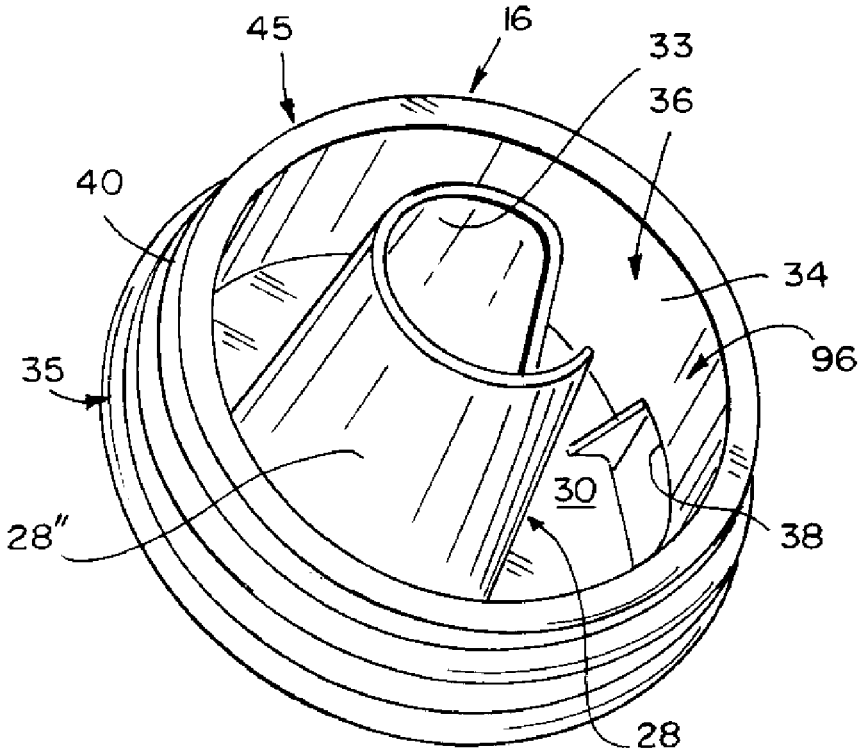
FIG. 4 is an enlarged perspective view of a top portion of the pour spout of FIGS. 1-3 showing a discharge tube located inside and coupled to a finish mount comprising a product drainback cup having product drainback aperture (on the lower right side) and an annular rim formed to include threads and arranged to surround an annular wall of the product drainback cup.
Figure 4A:
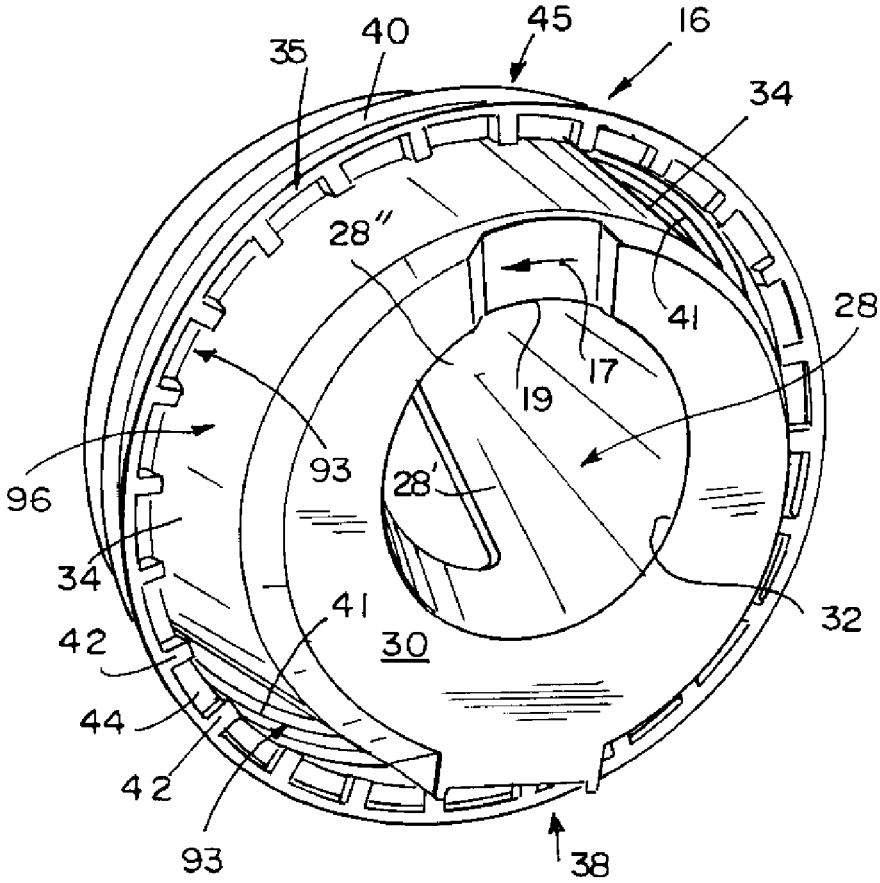
FIG. 4A is an enlarged perspective view of a bottom portion of the pour spout of FIG. 4 showing a weir associated with a channel formed in the underside of the pour spout and a series of circumferentially spaced-apart anti-rotation lug-receiving slots formed on a downwardly facing exterior portion of the rim of the pour spout and wherein each slot is sized to receive the anti-rotation lug provided on the neck finish.

Pour spout 16 is also formed to include a channel 17 providing a weir 19 shown in FIG. 4A and exposed to liquid 11 or other fluid material being poured as suggested in FIG. 6B. Weir 19 is configured and arranged to "set" the point at which liquid 11 is discharged from pour spout 16 so as to avoid having to tip container "to much" which could lead to unwanted "flooding" of the air vent provided by product-drainback aperture 38.

Pour spout 16 includes a finish mount 45 configured to mate with neck finish 14. In an illustrative embodiment, finish mount 45 is coupled to discharge tube 28 and comprises annular rim 35, a spout catch 86 provided on rim 35, and a product drainback cup 96 made of annular wall 34 and bottom wall 30. Spout catch 86 of finish mount 45 is configured to mate with spout catch retainer 84 included in neck finish 14 as suggested in FIGS. 3 and 6A to anchor pour spout 16 in a stationary, anchored position on container neck finish 14. Drainback cup 96 has an outer edge coupled to rim 35 and an inner edge coupled to discharge tube 28 as suggested in FIGS. 6A and 6B. Rim 35 is formed to include downwardly opening annular channel 93 receiving neck finish 14 therein as suggested in FIGS. 6A and 6B.

Spout catch 86 of pour spout 16 includes radially outwardly extending ridges 42 coupled to an interior surface of annular rim 35 of pour spout 16 as shown in FIG. 4A. Ridges 42 are arranged to lie in circumferentially spaced-apart relation to one another on an underside of pour spout 16 as suggested in FIGS. 3 and 4A. Each pair of adjacent ridges 42 cooperates to define an anti-rotation lug-receiving slot 44 therebetween. In an illustrative embodiment, pour spout 16 is formed to include a series of circumferentially spaced-apart downwardly facing anti-rotation lug-receiving slots 44 formed on a downwardly facing exterior portion of pour spout 16. Each anti-rotation lug-receiving slot 44 is sized and shaped to receive an anti-rotation lug 26 (or 126) therein as suggested in FIG. 3.

Closure cap 18 includes a cylindrical sleeve 70 extending downwardly from a top wall 71 and an outer shell 72 coupled to sleeve 70 and arranged to extend around sleeve 70 as suggested in FIGS. 2 and 6A. Cylindrical sleeve 70 and top wall 71 cooperate to form a liquid-material "measuring cup" providing a liquid-receiving region 79 shown in FIG. 5 for receiving liquid to be measured by a consumer after removal of closure cap 18 from pour spout 16. Outer shell 72 includes annular side wall 73 and an annular top wall 74 arranged to interconnect annular side wall 73 and annular top wall 74.

Figure 5:
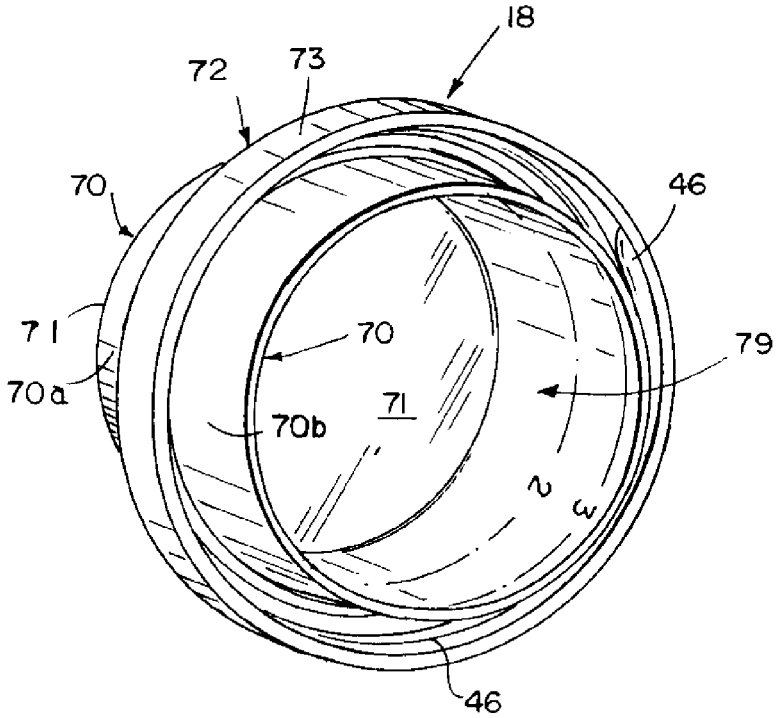
FIG. 5 is an enlarged perspective view of the underside of the closure cap of FIGS. 1-3 showing an annular outer shell arranged to surround a cylindrical sleeve and formed to include an interior thread configured to mate with an exterior thread on the rim of the pour spout.

In the illustrated embodiment, top wall 71 is round and cylindrical sleeve 70 includes an outer sleeve portion 70*a* extending between annular top wall 74 and round top wall 71 and an inner sleeve portion 70*b* extending in a downward direction from annular top wall 74 in an interior region bounded by annular side wall 73 of outer shell 72 as suggested in FIGS. 2, 5, and 6A. Inner sleeve portion 70*b* extends into product-drainback reservoir 36 to surround discharge tube 28 and be surrounded by annular wall 34 of pour spout 16 when closure cap 18 is mounted on pour spout 16 as suggested in FIG. 6A.

Closure unit 10 is preassembled by mating closure cap 18 to pour spout 16. For example, a "single-lead" internal thread 46 provided in an annular side wall 73 of closure cap 18 as shown in FIG. 5 mates with external thread 40 provided on an exterior surface of annular rim 35 of pour spout 16 as suggested in FIG. 6A. It is within the scope of this disclosure to use any suitable mating technique or structure.

As suggested in FIGS. 3 and 6A, preassembled closure unit 10 is moved downwardly toward mating engagement with underlying container neck finish 14 of container 15 to anchor pour spout 16 in a stationary, anchored position on container neck finish 14. A spout catch 86 included in pour spout 16 is configured to mate with a spout catch retainer 84 included in neck finish 14 to anchor pour spout 16 on neck finish 14 as shown, for example, in FIG. 6A. In an illustrative embodiment, spout catch 86 is provided on an interior surface of annular rim 35 of pour spout 16 and spout catch retainer 84 is provided on annular outer surface 21 of neck finish 14 as suggested in FIG. 3.

A bottler receives container 15 from a container manufacturer and a preassembled closure unit 10 from a closure manufacture in an illustrative manufacturing system. As suggested in FIG. 3, the bottler fills container 15 with product 20 by discharging product 20 through "wide-mouth" opening 12 using dispenser 22 before preassembled closure unit 10 is coupled to neck finish 14. Herein, reference is made to a "wide-mouth" opening, which is any opening not occluded in whole or in part by a pour spout or the like. The diameter of wide-mouth opening 12 is not important and could be any suitable diameter. However, no pour spout is present in wide-mouth opening 12 when product 20 is discharged into container 15 using dispenser 22 so that container 15 can be filled faster and more easily using preassembled closure unit 10 in accordance with the present disclosure.

Once container 15 is filled with product 20, preassembled closure unit 10 is coupled to neck finish 14 of container 15 in any suitable manner. As suggested in FIG. 3, an internal single-lead thread 41 provided on pour spout 16 mates with thread 24 on neck finish 14 during clockwise motion of closure unit 10 about a vertical axis 23 relative to container neck finish 14.

Spout catch 86 of pour spout 16 comprises interior thread 41 and ridges 42 provided on annular rim 35 and anti-rotation lug-receiving slots 44 formed between pairs of adjacent ridges 42 as suggested, for example, in FIG. 3. In one illustrative embodiment, spout catch retainer 84 is defined by exterior thread 24 and anti-rotation lug 26 (shown in solid) on neck finish 14 and, in another illustrative embodiment, spout catch retainer 84' is defined by exterior thread 24 and anti-rotation lug 126 (shown in phantom) on neck finish 14 as suggested in FIG. 3.

In an illustrative embodiment, anti-rotation lug 26 on neck finish 14 fits into an anti-rotation lug-receiving slot 44 formed in pour spout 16 of preassembled closure unit 10 to allow counterclockwise movement of pour spout 16 relative to neck finish 14 about axis 23 during installation of preassembled closure unit 10 in opening 12 of neck finish 14 and to block clockwise movement of pour spout 16 relative to neck finish 14 about axis 23 during clockwise rotation of closure cap 18 in a "cap-removal" direction. This causes pour spout 16 to remain in a stationary anchored position on neck finish 14 during removal of closure cap 18 from pour spout 16 to expose fluid-discharge outlet 33 of discharge tube 28. During assembly, preassembled closure unit 10 rotates about axis 23 relative to container neck finish 14 and each ridge 42 "rides on" an upwardly facing inclined ramp 25 of anti-rotation lug 26 until anti-rotation lug 26 fits into one of anti-rotation lug-receiving slots 44. Then, a side wall of each ridge 42 mates with an adjacent vertical stop wall 27 on anti-rotation lug 26 to block further rotation of preassembled closure unit 10 relative to container neck finish 14 about axis 23.

Any suitable seal such as annular seal 95 can be provided as shown, for example, in FIG. 6A. Annular seal 95 establishes a sealed connection between pour spout 16 and closure cap 18 when closure cap 18 is mounted on pour spout 16.

In use, closure unit 10 is preassembled and screws on to neck finish 14 of bottle or container 15. Then, when closure unit 10 is installed by a bottler in opening 12 of neck finish 14, pour spout 16 locks in place and remains in a stationary, anchored position locked on neck finish 14 of container 15 during later removal of closure cap 18 from an initial mounted position on pour spout 16 owing to use of a suitable "anti-rotation" system between pour spout 16 and neck finish 14. One illustrative example of an anti-rotation system is defined by anti-rotation lugs 26 on neck finish 14 that fit into companion lug-receiving slots 44 formed in pour spout 16. The single-lead threads are used to orient closure cap 18, pour spout 16, and neck finish 14 in a predetermined orientation relative to one another. Accordingly, pour spout 16 is inserted after container filling when closure unit 10 is mounted in container neck finish 14 so that pour spout 16 is "invisible" to the bottler.

Once closure cap 18 has been removed from pour spout 16 by a consumer, a liquid 11 (or other product) stored in container 15 can be discharged from container 15 through discharge tube 28 included in the "exposed" pour spout 16 as suggested, for example, in FIG. 6B. As liquid 11 is discharged from container 15, "make-up" air 13 flows from the surrounding atmosphere into container 15 through reservoir 36 and product-drainback aperture 38 as suggested, for example, in FIG. 6B.

A preassembled closure unit 210 in accordance with a second embodiment of the present disclosure is shown, for example, in FIGS. 7-13. In this embodiment, "multi-lead" threads are used to provide suitable and nearly 360° retention of one component relative to another while providing a consumer or bottler with perhaps "quarter-turn" installation and removal.

Figure 8:
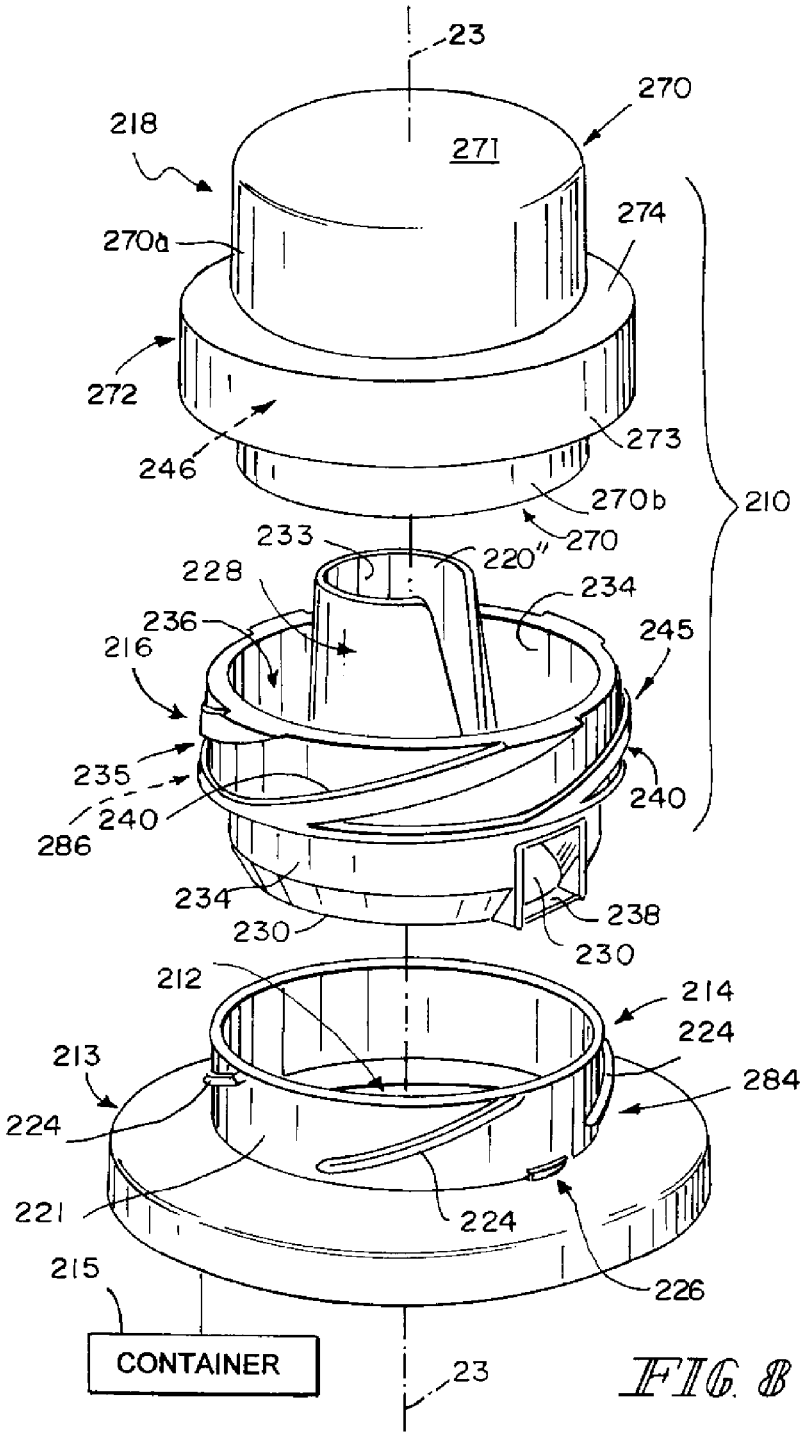
FIG. 8 is an exploded assembly view of the components illustrated in FIG. 7 showing an annular neck finish coupled to a container and a separate closure unit comprising a closure cap and a pour spout located between the neck finish and the closure cap and showing a radially outwardly projecting trapezoidal anti-rotation lug formed on an exterior portion of the neck finish.
Figure 9:
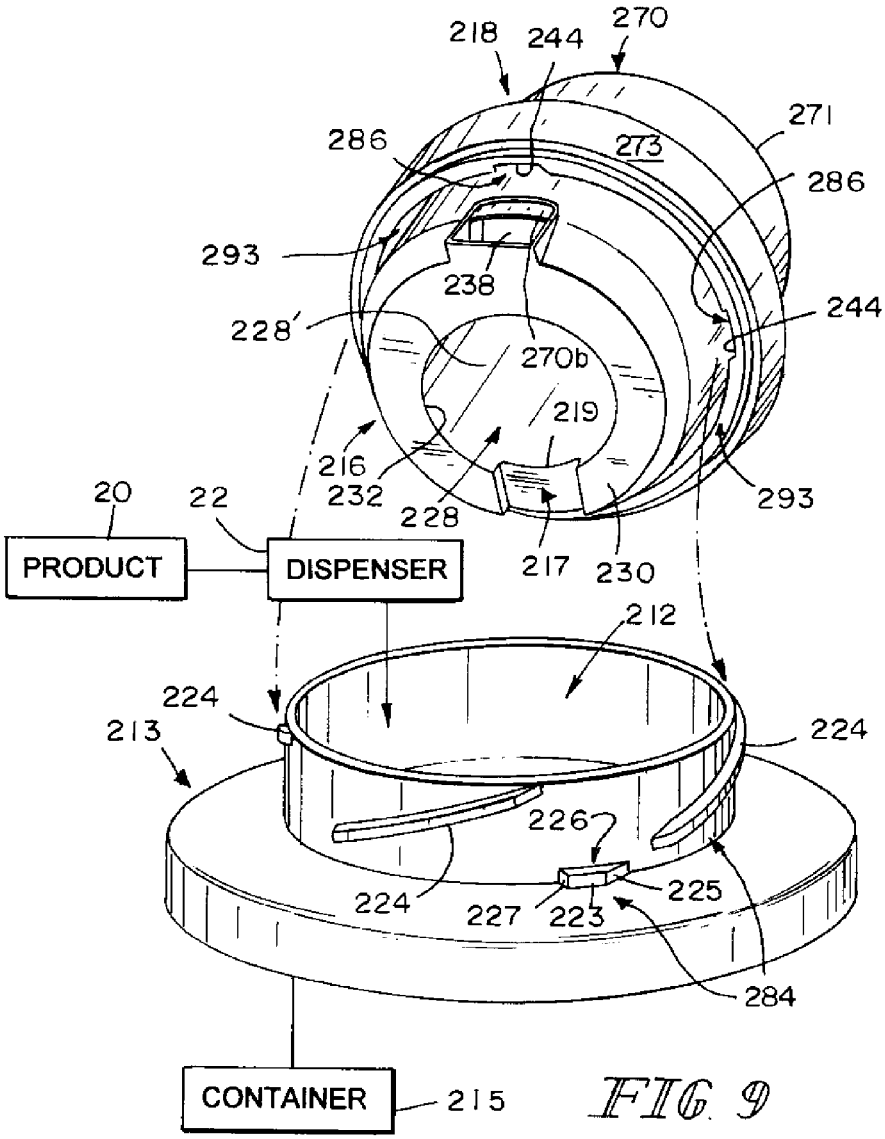
FIG. 9 is an enlarged perspective view showing a preassembled closure unit of the type shown in FIGS. 7 and 8 as it is being installed on the neck finish of a container by a bottler after the container has been filled with liquid or other product discharged by a dispenser into the container through a "wide-mouth" opening provided in the container neck finish.

Closure unit 210 includes a pour spout 216 and a closure cap 218 and, once preassembled, mounts in a wide-mouth opening 212 formed in a neck finish 214 coupled to a top wall 213 of a container 215. Neck finish 214 includes an annular outer surface 221 and several multi-lead threads 224 and anti-rotation lugs 226 coupled to annular outer surface 221 as shown in FIGS. 8 and 9. Neck finish 214 includes a spout catch retainer 284 that is configured to mate with a spout catch 286 included in a finish mount 245 of pour spout 216 to anchor pour spout 216 in a stationary, anchored position on neck finish 214 as suggested in FIGS. 9 and 13.

Figure 12:
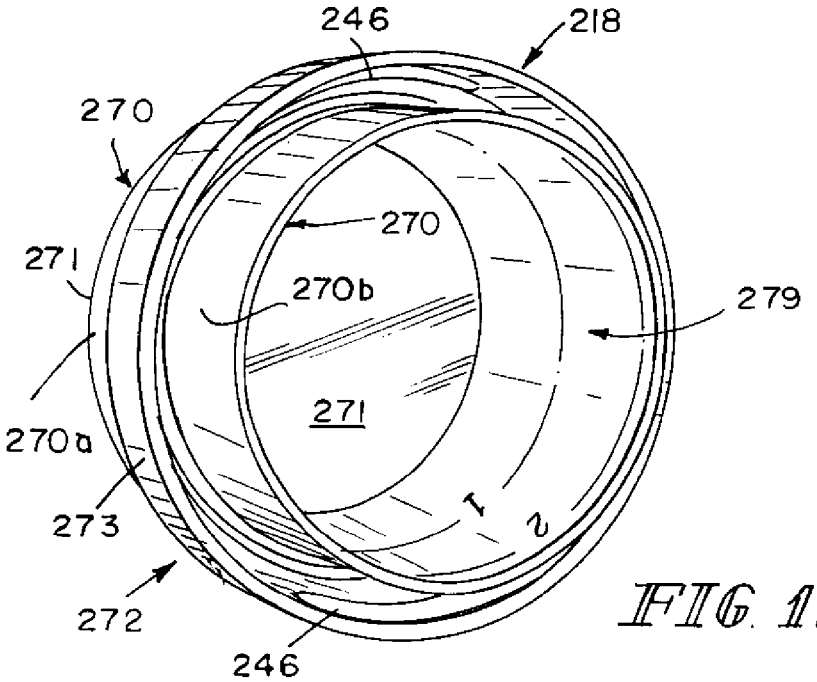
FIG. 12 is an enlarged perspective view of the underside of the closure cap of FIGS. 7-9.
Figure 13:
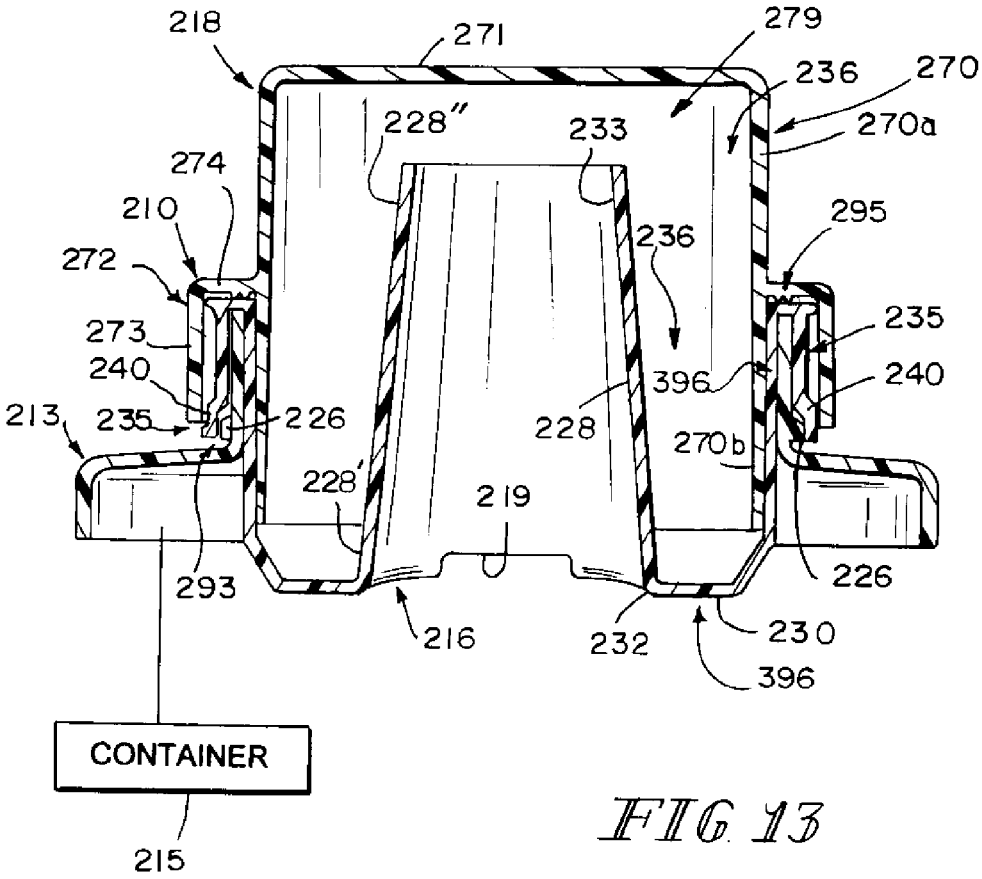
FIG. 13 is a sectional view of the components shown in FIGS. 7-12 suggesting use of a first set of mating flanges to couple the pour spout to the surrounding closure cap to form the closure unit and suggesting the use of a second set of mating flanges to couple the closure unit to the container neck finish along an interface between the container neck finish and the surrounding pour spout.
Figure 14:
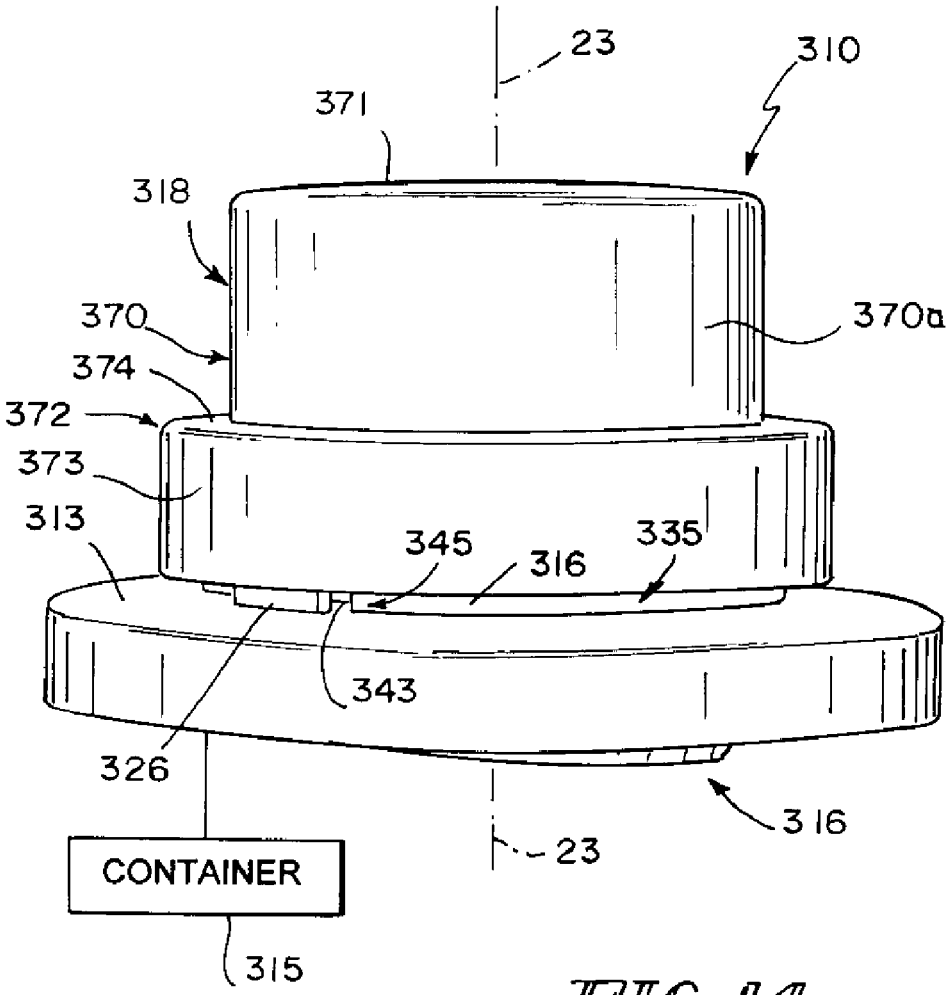
FIG. 14 is a perspective view of a closure unit in accordance with a third embodiment of the present disclosure coupled (for later removal) to a neck finish (neck) of a container.

Closure cap 218 includes a cylindrical sleeve 270 extending downwardly from a top wall 271 and an outer shell 272 coupled to sleeve 270 and arranged to extend around sleeve 270 as suggested in FIGS. 8 and 13. Cylindrical sleeve 270 and top wall 271 cooperate to define a liquid-receiving region 279 for liquid-measuring purposes as shown in FIG. 12. Outer shell 272 includes annular side wall 273 and an annular top wall 274 arranged to interconnect annular side wall 273 and annular top wall 274.

In the illustrated embodiment, top wall 271 is round and cylindrical sleeve 270 includes an outer sleeve portion 270*a* extending between annular top wall 274 and round top wall 271 and an inner sleeve portion 270*b* extending in a downward direction from annular top wall 274 in an interior region bounded by annular side wall 273 of outer shell 272. Inner sleeve portion 270*b* extends into product-drainback reservoir 236 to surround discharge tube 228 when closure cap 218 is mounted on pour spout 216 as suggested in FIG. 13.

As suggested in FIGS. 8 and 13, closure unit 210 is moved downwardly toward mating engagement with underlying container neck finish 214 of container 215 to anchor pour spout 216 in a stationary, anchored position on container neck finish 214. A spout catch 286 included in pour spout 216 is configured to mate with a spout catch receiver 284 included in neck finish 214 to anchor pour spout 216 on neck finish 214 as shown in FIG. 13. In an illustrative embodiment, spout catch 286 is provided on an interior surface of annular wall 235 of pour spout 216 and spout catch receiver 284 is provided on annular outer surface 221 of neck finish 214 as suggested in FIG. 9.

Figure 10:
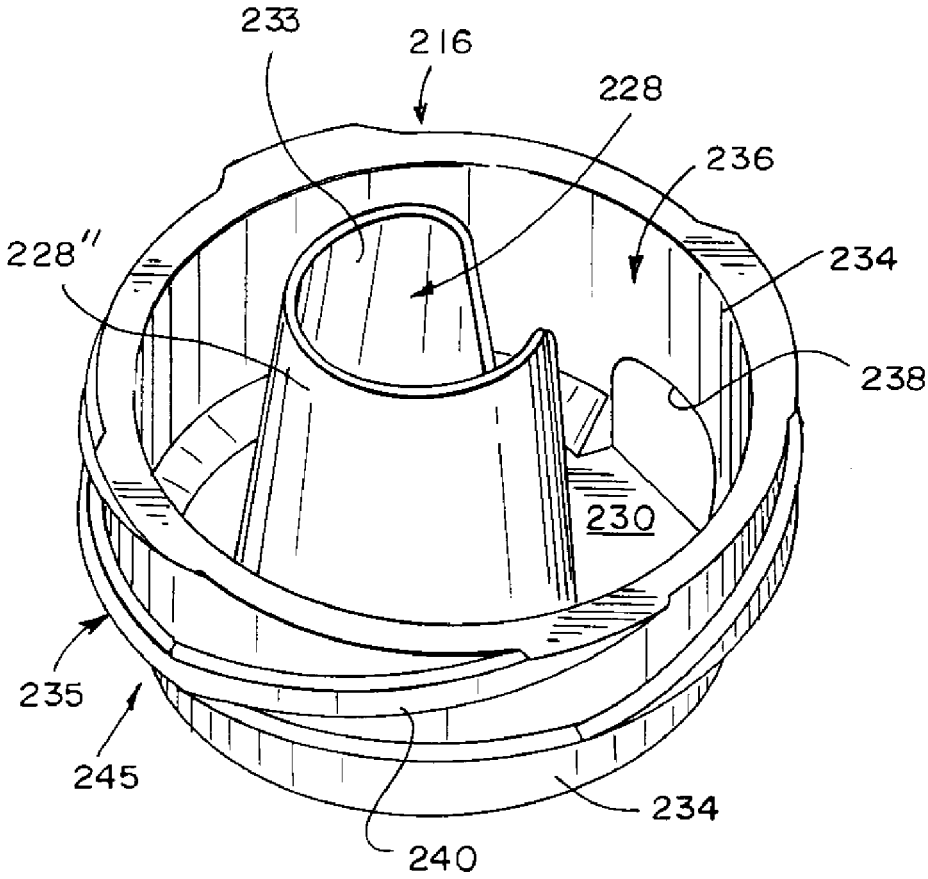
FIG. 10 is an enlarged perspective view of the pour spout of FIGS. 7-9 taken from a first point of view.

Pour spout 216 includes an upright discharge tube 228 and a product drainback cup 296. Upright discharge tube 228 is coupled to a bottom wall 230 of product drainback cup 296 at a fluid-admission inlet 232. Product drainback cup 296 includes an annular wall 234 coupled to a perimeter edge of bottom wall 230 to form a product-drainback reservoir 236 surrounding discharge tube 228. As suggested in FIGS. 8, 11, and 13, discharge tube 228 is formed to include an inner portion 228' formed to include a fluid-admission inlet 232 arranged to open into an interior region of container 215 and an outer portion 228" formed to include fluid-discharge outlet 233. Annular wall 234 is formed to include a product-drainback aperture 238 communicating with reservoir 236 as shown in FIG. 10 and an outer surface of annular wall 234 is formed to include, for example, several multi-lead threads 240 as shown in FIGS. 8 and 10. Pour spout 216 is also formed to include a channel 217 providing a weir 219 shown in FIGS. 9 and 11 for managing liquid being poured (as suggested in FIG. 6B).

Pour spout 216 includes a finish mount 245 configured to mate with neck finish 214. In an illustrative embodiment, finish mount 245 is coupled to discharge tube 228 and comprises annular rim 235, a spout catch 286 provided on rim 235, and a product drainback cup 296 made of annular wall 234 and bottom wall 230. Spout catch 286 of finish mount 245 is configured to mate with spout catch retainer 284 included in neck finish 214 as suggested in FIGS. 9 and 13 to anchor pour spout 216 in a stationary, anchored position on container neck finish 214. Drainback cup 296 has an outer edge coupled to rim 235 and an inner edge coupled to discharge tube 228 as suggested in FIG. 13. Spout catch 286 is formed to include four circumferentially spaced-apart anti-rotation lug-receiving slots 244 adapted to receive anti-rotation lugs 226 formed in neck finish 214. Each anti-rotation lug 226 includes a radially outwardly facing inclined ramp 225, a vertical stop wall 227, and a guide wall 223 extending therebetween as shown, for example, in FIG. 9. Lugs 226 and slots 244 function in a manner similar to lugs 26 and slots 44 disclosed in the embodiment of FIGS. 1-6A.

Figure 11:
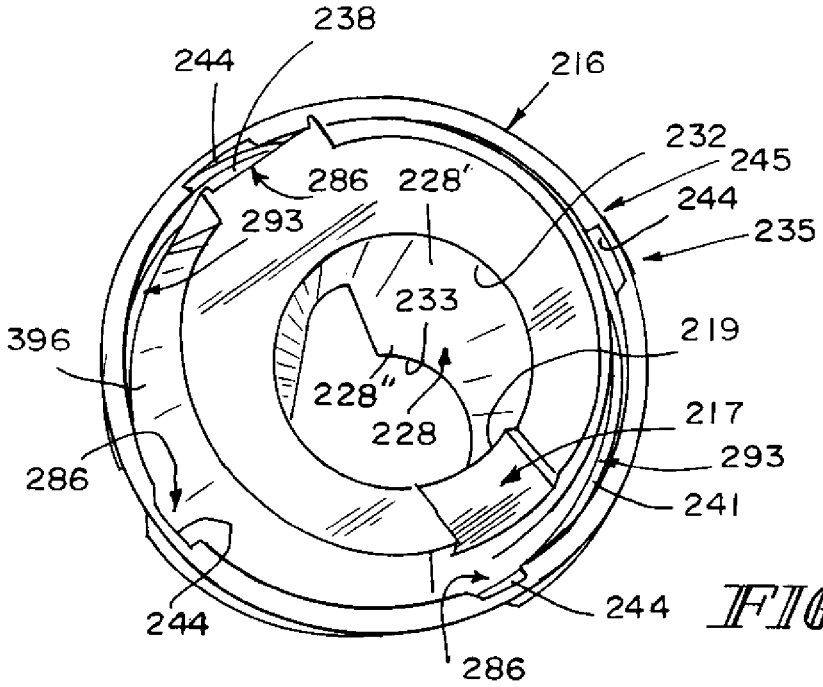
FIG. 11 is an enlarged perspective view of a bottom portion of the pour spout of FIG. 10 showing four circumferentially spaced-apart anti-rotation lug-receiving slots provided in a downwardly opening annular channel formed in the pour spout and each slot being sized to receive an anti-rotation lug provided on the neck finish.

Spout catch 286 of pour spout 216 comprises thread 241 coupled to an interior surface of annular rim 235 and anti-rotation lug-receiving slots 244 formed in annular rim 235, as suggested, for example, in FIGS. 9, 11, and 13. In an illustrative embodiment, spout catch retainer 284 is defined by threads 224 and anti-rotation lugs 226 on neck finish 214 as suggested in FIG. 9. Rim 235 is formed to include a downwardly opening annular channel 293 receiving neck finish 214 therein as suggested in FIGS. 9, 11, and 13.

Closure unit 210 is preassembled by mating closure cap 218 to pour spout 16. For example, multi-lead threads 246 provided on an interior wall of annular side wall 273 of closure cap 218 as shown in FIG. 12 mate with the multi-lead threads 240 provided on rim 235 of pour spout 216. Internal multi-lead threads 241 provided on pour spout 216 mate with threads 224 provided on neck finish 214 during clockwise motion of preassembled closure unit 210 about a vertical axis 23 relative to neck finish 214. A seal 295 is established between closure cap 218 and pour spout 216 as suggested in FIG. 13.

A preassembled closure unit 310 in accordance with a third embodiment of the present disclosure is shown, for example, in FIGS. 14-19. In this embodiment, preassembled closure unit 310 is "snap-fit" to neck finish 314 using, for example, a plug seal. Radio-frequency (RF) cured glue or other suitable bonding or adhesive system can be used to retain snap-fit closure unit 310 to neck finish 314 to supplement the snap-fit connection if desired.

Closure unit 310 includes pour spout 316 and closure cap 318 and once preassembled mounts in a "wide-mouth" opening 312 formed in neck finish 314 coupled to top wall 313 of container 315. A simpler spout mold is used to produce pour spout 316. A parting line 100 is shown on pour spout 316 in FIGS. 15 and 17A and no "side action" in the "pour spout" mold is required. The parting line follows the thread pitch.

Figure 15:
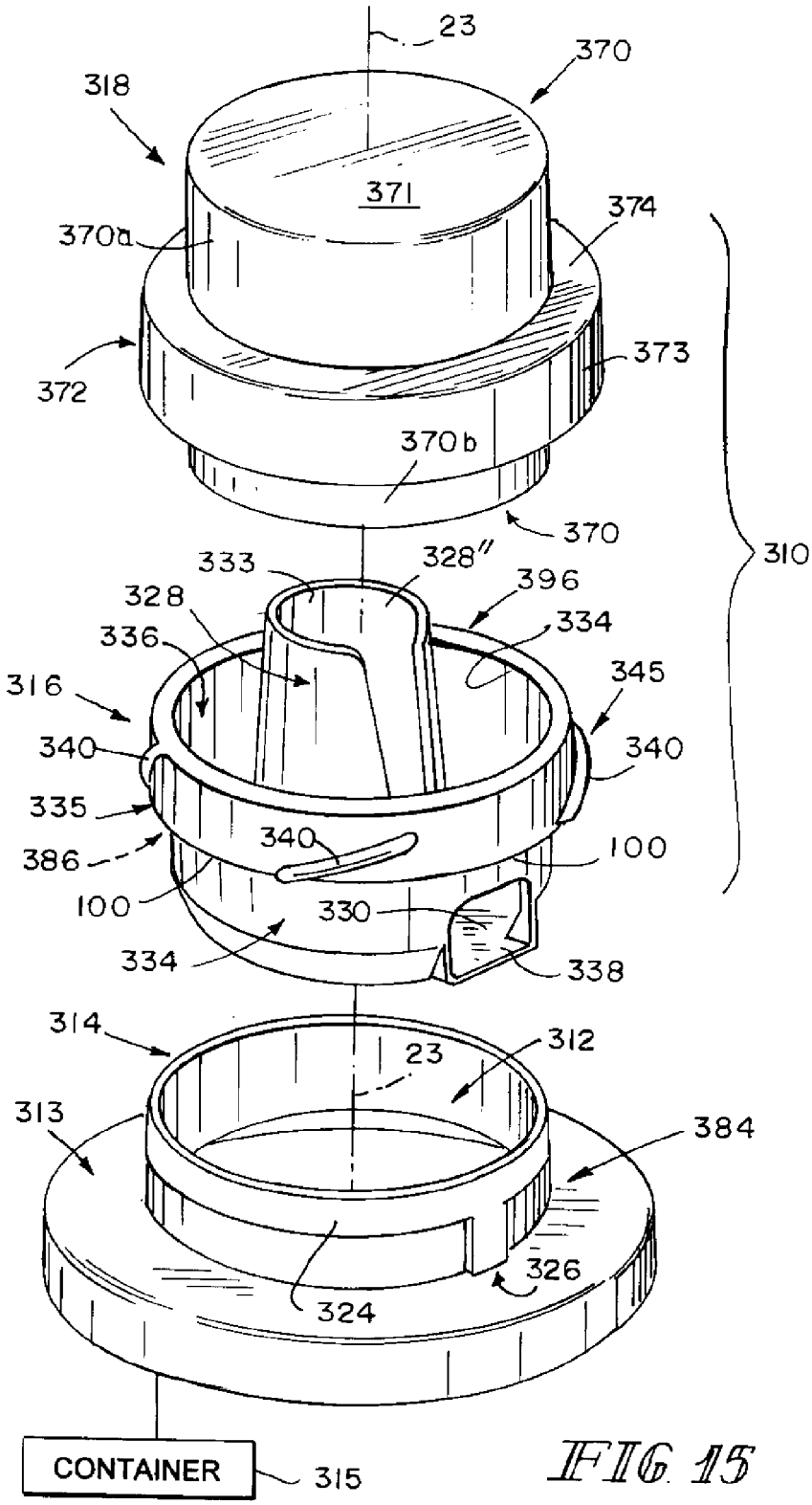
FIG. 15 is an exploded assembly view of the components illustrated in FIG. 14 showing an annular neck finish coupled to a container and a separate (unassembled) closure unit comprising a closure cap and a pour spout located between the neck finish and the closure cap and showing a radially outwardly projecting rectangular anti-rotation lug formed on an upstanding annular side wall of the neck finish.
Figure 18:
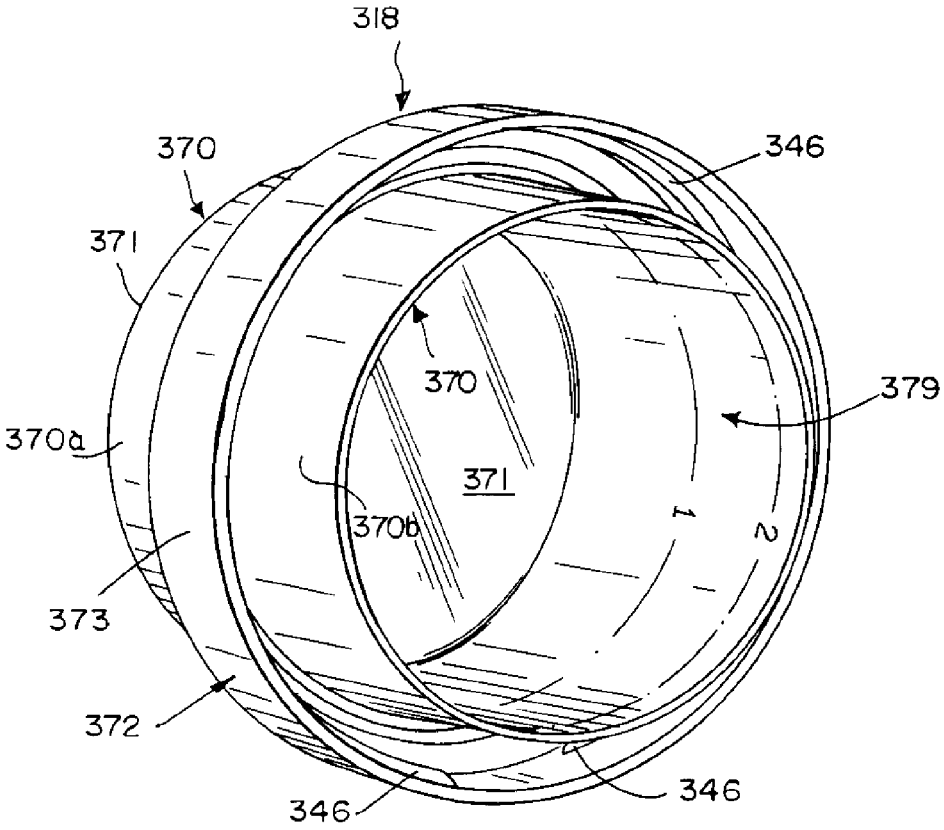
FIG. 18 is an enlarged perspective view of the underside of the closure cup of FIGS. 14-16.
Figure 19:
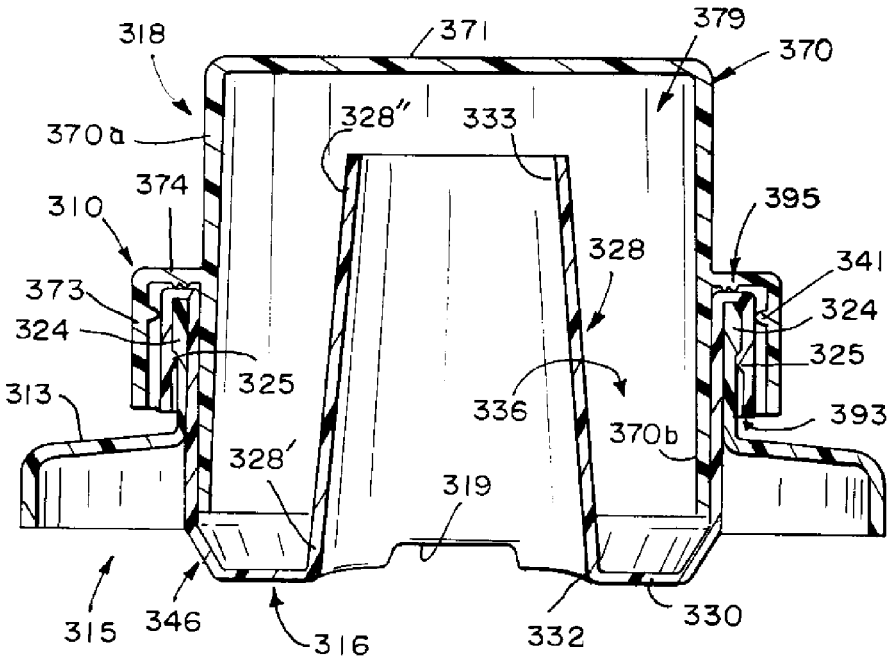
FIG. 19 is a sectional view showing use of a first set of mating threads to couple the pour spout to the surrounding closure cap to form the closure unit and showing the use of a second set of mating flanges to couple the closure unit to the container neck finish using a "snap-fit" connection along an interface between the container neck finish and the surrounding pour spout.
Figure 20:
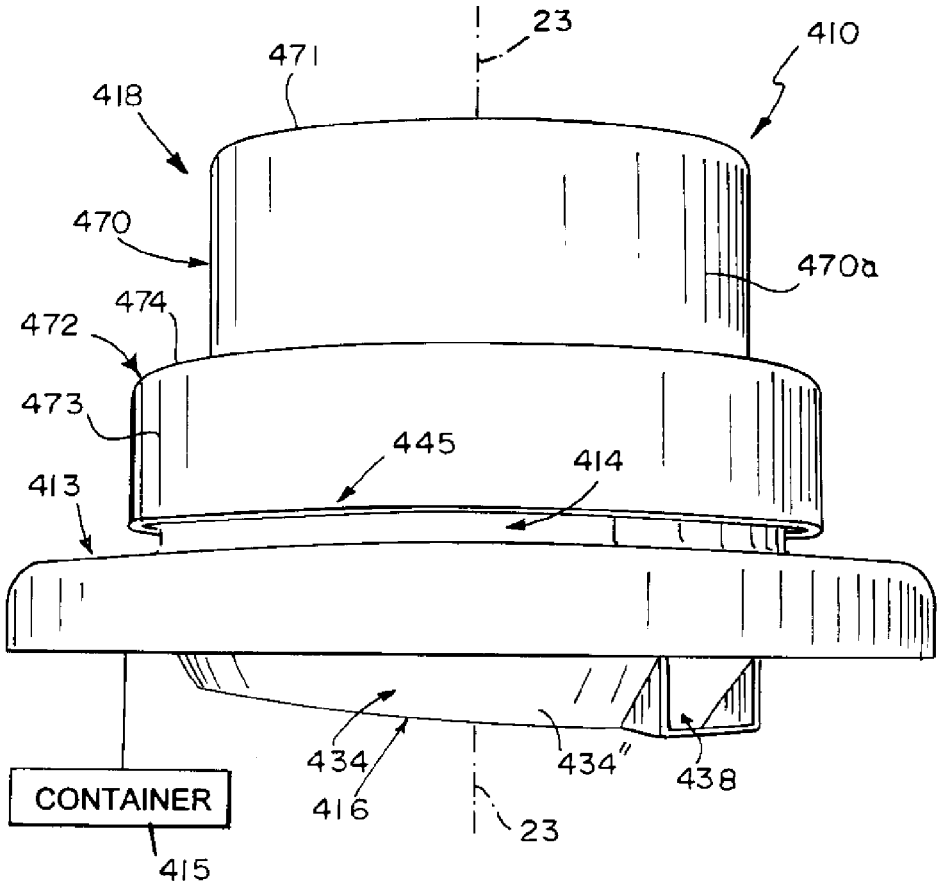
FIG. 20 is a perspective view of a closure unit in accordance with a fourth embodiment of the present disclosure coupled (for later removal) to a neck finish of a container.

Closure cap 318 includes a cylindrical sleeve 370 extending downwardly from a top wall 371 and an outer shell 372 coupled to sleeve 370 and arranged to extend around sleeve 370 as suggested in FIGS. 15 and 19. Cylindrical sleeve 270 and top wall 371 cooperate to define a liquid-receiving region 379 for liquid-measuring purposes as shown in FIG. 18. Outer shell 372 includes annular side wall 373 and an annular top wall 374 arranged to interconnect annular side wall 373 and annular top wall 374.

In the illustrated embodiment, top wall 371 is round and cylindrical sleeve 370 includes an outer sleeve portion 370*a* extending between annular top wall 374 and round top wall 371 and an inner sleeve portion 370*b* extending in a downward direction from annular top wall 374 in an interior region bounded by annular side wall 373 of outer shell 372. Inner sleeve portion 370*b* extends into product-drainback reservoir 336 to surround discharge tube 328 when closure cap 318 is mounted on pour spout 316 as suggested in FIG. 19.

Figure 16:
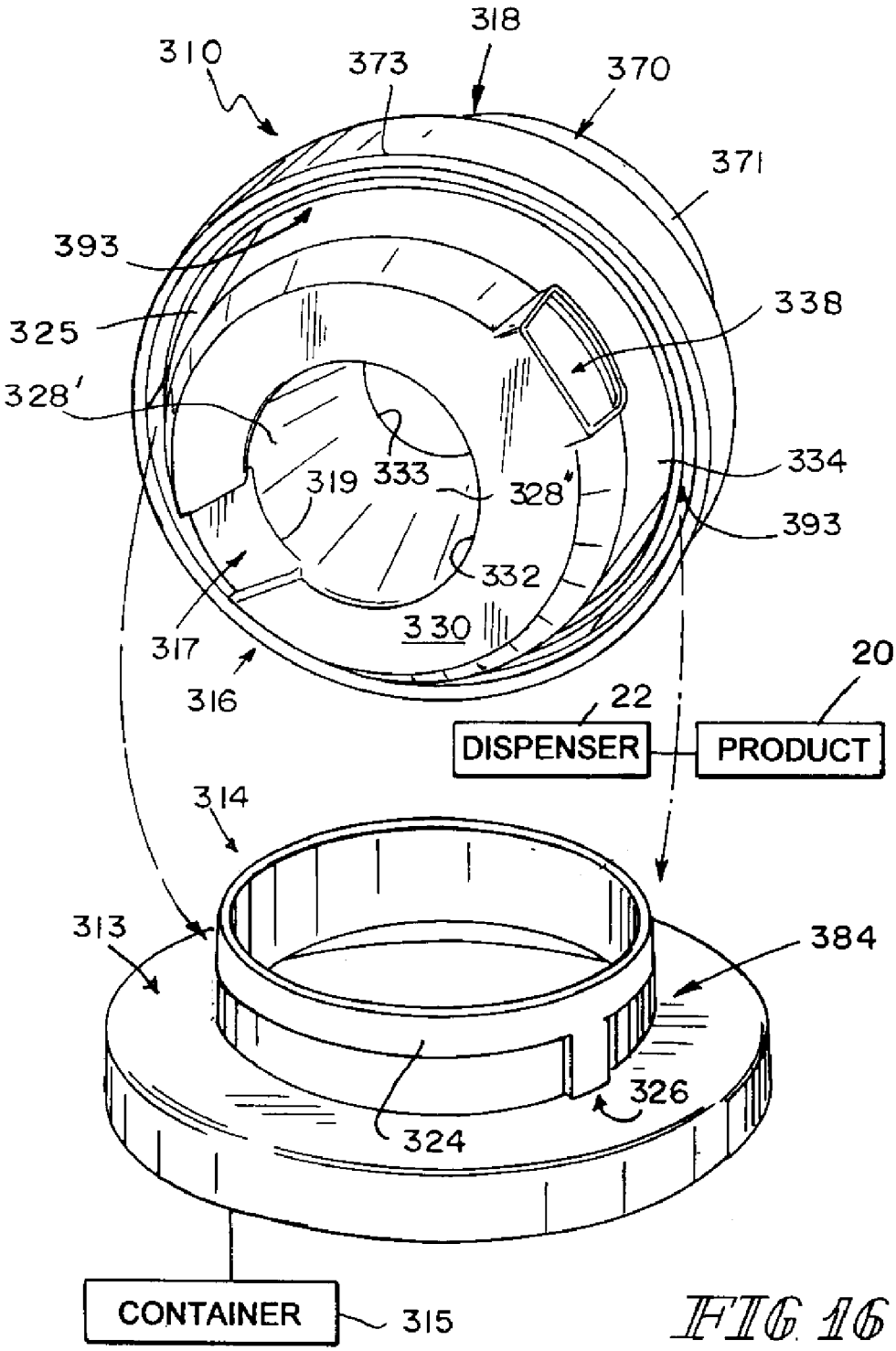
FIG. 16 is an enlarged perspective view showing a preassembled closure unit of the type shown in FIGS. 14 and 15 as it is being installed on the neck finish of a container by a bottler after the container has been filled with liquid or other product discharged by a dispenser into the container through a "wide-mouth" opening provided in the container neck finish.

Pour spout 316 includes an upright discharge tube 328 and a product drainback cup 396. Upright discharge tube 328 is coupled to a bottom wall 330 of product drainback cup 396 at a fluid-discharge outlet 333. Product drainback cup 396 further includes an annular wall 334 coupled to a perimeter edge of bottom wall 330 to form a product-drainback reservoir 336 surrounding discharge tube 328. As suggested in FIGS. 15, 16, and 19, discharge tube 328 is formed to include an inner portion 328' formed to include a fluid-admission inlet 332 arranged to open into an interior region of container 315 and an outer portion 328" formed to include fluid-discharge outlet 333. Annular wall 334 is formed to include a product-drainback aperture 338 communicating with reservoir 336 as shown in FIG. 15 and an outer surface of annular wall 334 is formed to include, for example, a flange 325 as shown in FIGS. 15, 16, and 19. Pour spout 316 is also formed to include a channel 317 providing a weir 319 shown in FIGS. 16 and 19 for managing liquid being poured.

Pour spout 316 includes a finish mount 345 configured to mate with neck finish 314. In an illustrative embodiment, finish mount 345 is coupled to discharge tube 328 and comprises annular rim 335, a spout catch 386 provided on rim 335, and a product drainback cup 346 made of annular wall 334 and bottom wall 330. Spout catch 386 of finish mount 345 is configured to mate with spout catch retainer 284 included in neck finish 314 as suggested in FIGS. 15 and 19 to anchor pour spout 316 in a stationary, anchored position on container neck finish 314. Drainback cup 346 has an outer edge coupled to rim 335 and an inner edge coupled to discharge tube 328 as suggested in FIG. 19.

As suggested in FIGS. 16 and 19, closure unit 310 is moved downwardly toward mating engagement with underlying container neck finish 314 of container 315 to anchor pour spout 316 in a stationary, anchored position on container neck finish 314. A spout catch 386 included in pour spout 316 is configured to mate with a spout catch receiver 384 included in neck finish 314 to anchor pour spout 316 on neck finish 314 as shown in FIG. 19. In an illustrative embodiment, spout catch 386 is provided on an interior surface of annular wall 335 and spout catch receiver 384 is provided on annular outer surface 321 of neck finish 314 as suggested in FIG. 16.

Figure 17A:
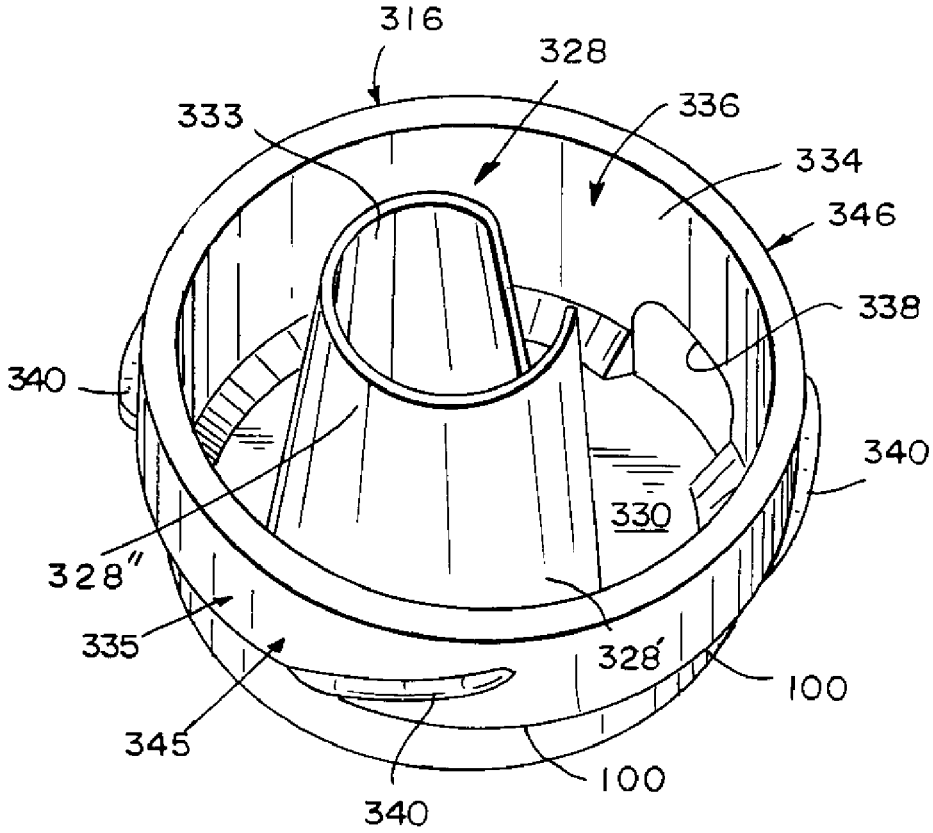
FIG. 17A is an enlarged perspective view of a top portion of the pour spout of FIGS. 14-16.
Figure 17B:
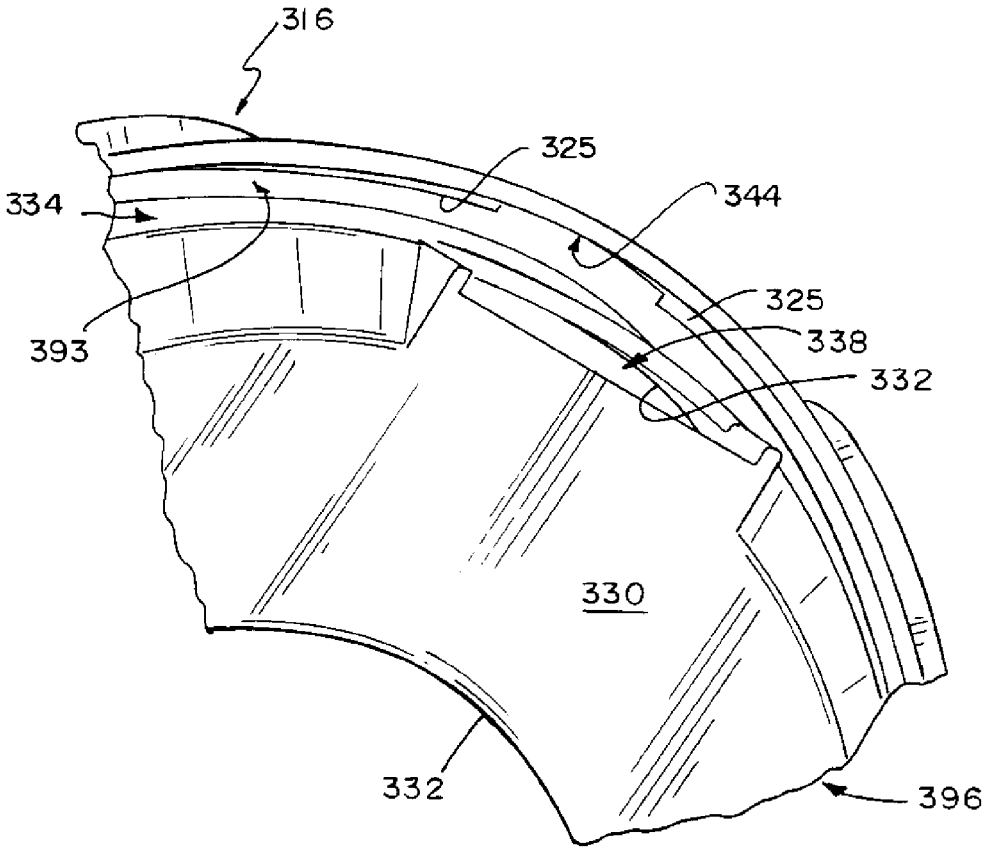
FIG. 17B is an enlarged partial perspective view of a bottom portion of the pour spout of FIG. 17A showing an anti-rotation lug-receiving slot provided in a downwardly opening annular channel formed in the pour spout and sized to receive one of the anti-rotation lugs provided on the neck finish.

A radially outwardly projecting rectangular anti-rotation lug 326 is formed on an upstanding annular side wall of container neck finish 314 as shown in FIG. 15. Preassembled closure unit 10 is being installed on neck finish 314 of container 315 by a bottler after container 315 has been filled with liquid or other product 20 discharged by a dispenser 222 into container 315 through a "wide-mouth" opening 312 provided in container neck finish 314. An enlarged partial perspective view of a bottom portion of the pour spout 316 is provided in FIG. 17B showing an anti-rotation lug-receiving slot 344 included in spout catch 386 and provided in a downwardly opening annular channel formed in pour spout 316 and sized to receive one of anti-rotation lugs 326 provided on container neck finish 314.

Spout catch 386 of pour spout 316 comprises thread 341 and anti-rotation lug-receiving slot 344 on annular wall 335 as suggested, for example, in FIG. 16. In an illustrative embodiment, spout catch retainer 384 is defined by anti-rotation lug(s) 326 on neck finish 314 and a flange 324 on neck finish 314 as suggested in FIG. 16. Rim 335 is formed to include a downwardly opening annular channel 393 receiving neck finish 314 therein as suggested in FIGS. 15, 16, and 17B.

Use of a first set of mating threads 340, 341 to couple pour spout 316 to the surrounding closure cap 315 to form closure unit 310 is shown in FIG. 19. The use of a second set of mating flanges 324, 325 to couple closure unit 310 to container neck finish 314 using a "snap-fit" connection along an interface between container neck finish 314 and the surrounding pour spout 316 is also shown in FIG. 19.

A preassembled closure unit 410 in accordance with a fourth embodiment of the present disclosure is shown, for example, in FIGS. 20-27. In this embodiment, closure unit 410 is preassembled and established using a suitable relatively loose interference fit to couple a pour spout 416 to a closure cap 418. Closure cap 418 is configured to mate with a container neck finish 414 during mounting of closure unit 410 on container neck finish 414 at the factory to establish a relatively stronger "tight" interference (or plug) fit during simultaneous insertion of pour spout 416 into a wide-mouth opening 412 formed in container neck finish 414 and mating engagement of pour spout 416 and container neck finish 414. Later, when closure cap 418 is removed from container neck finish 414 by a consumer to access a fluid material or other product stored in container 415, the relatively loose interference fit between closure cap 418 and pour spout 416 will be "broken" to allow separation of closure cap 418 from pour spout 416 without disrupting or otherwise "breaking" the relatively tighter or stronger interference fit between pour spout 416 and container neck finish 414 so as to leave pour spout 416 in a stationary, anchored position in neck finish 414 of container 415 following removal of closure cap 418. Thereafter, pour spout 416 remains in the stationary, anchored position on container neck finish 414 during repeated installation of closure cap 418 on and removal of closure cap 418 from container neck finish 414.

Figure 21:
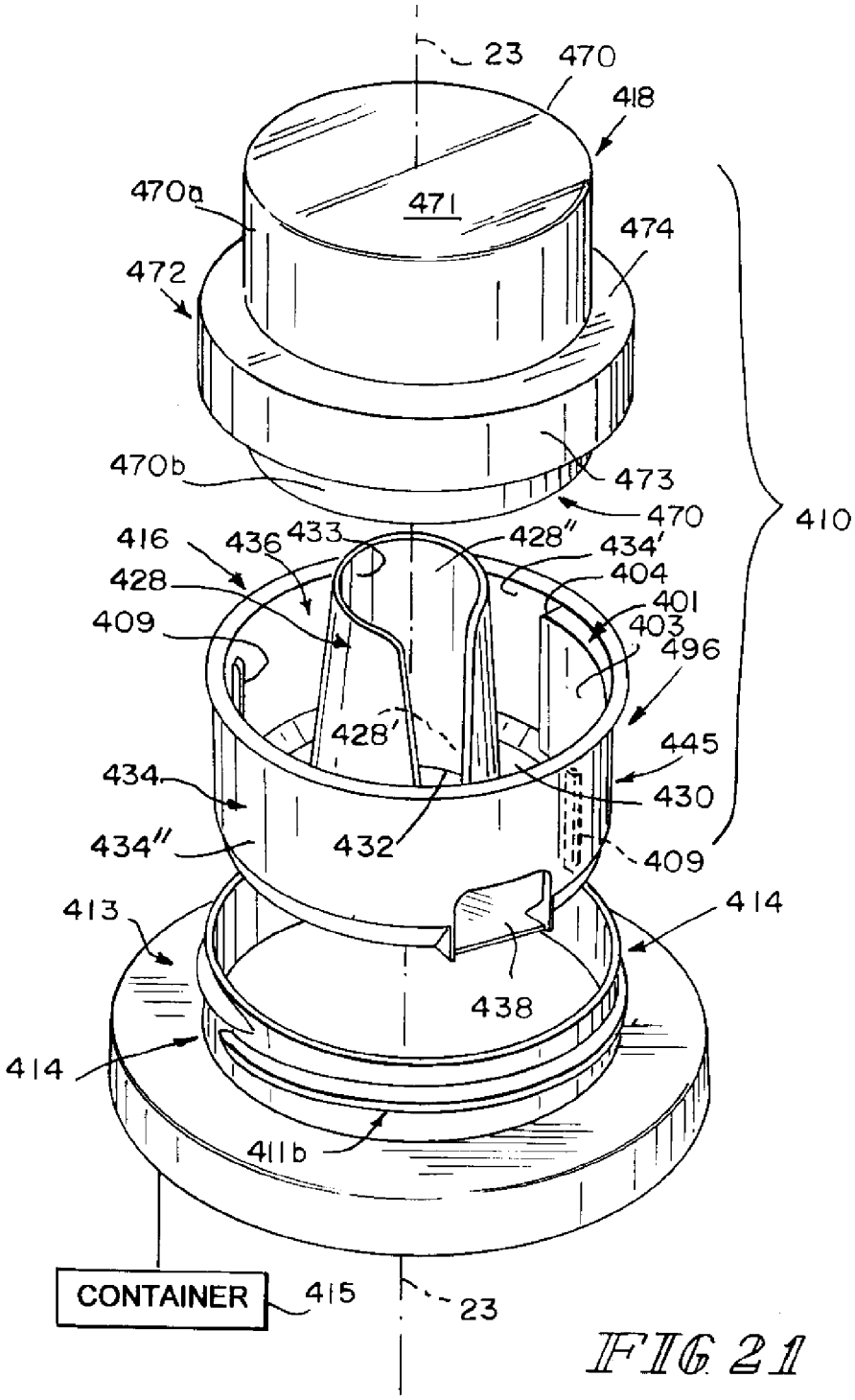
FIG. 21 is an exploded assembly view of the components illustrated in FIG. 20 showing a threaded annular neck finish coupled to a container and a separate (unassembled) closure unit comprising a closure cap and a pour spout located between the neck finish and the closure cap.
Figure 24:
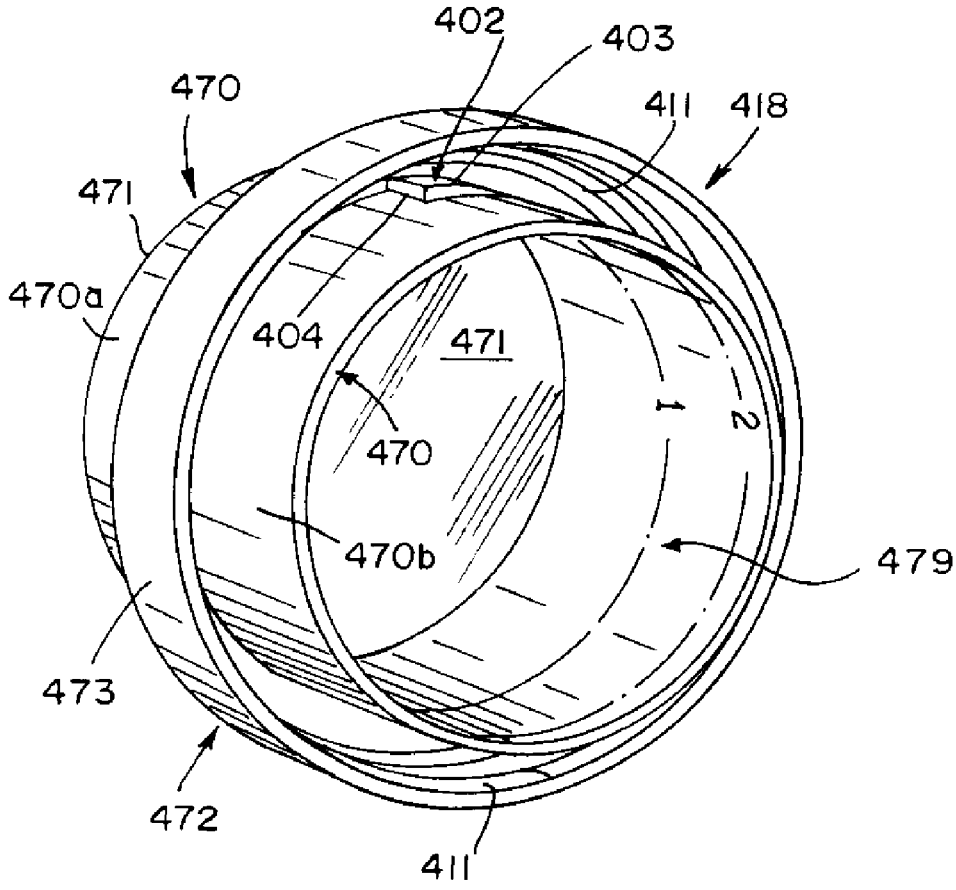
FIG. 24 is an enlarged perspective view of the underside of the closure cap of FIGS. 20-22 showing a drive lug including a ramp terminating at a stop wall provided on an exterior side wall of an inner sleeve of the closure cap.
Figure 25:
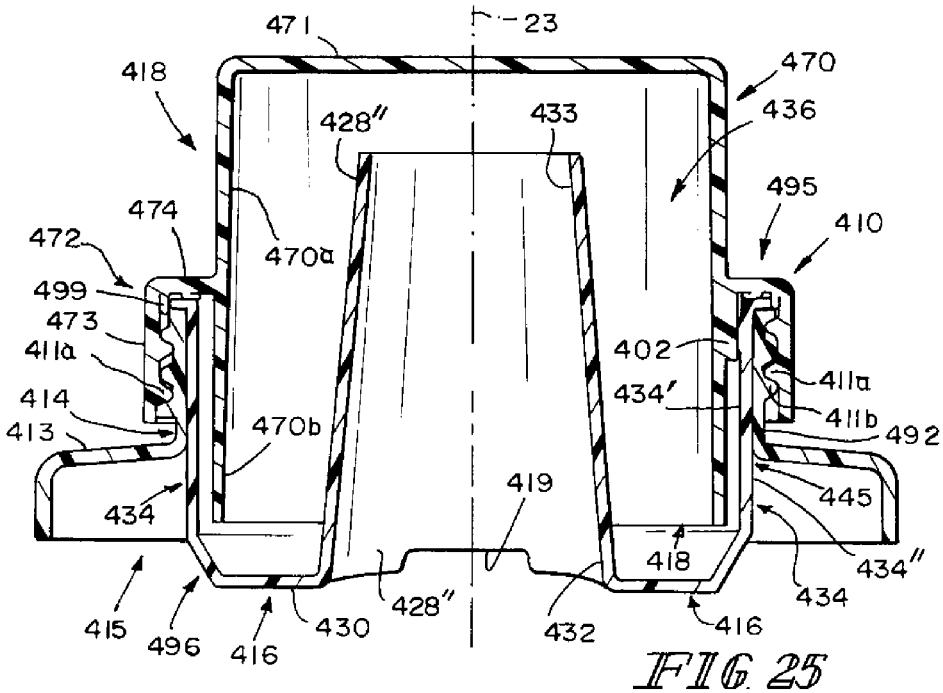
FIG. 25 is a sectional view of the components shown in FIGS. 20-24 showing use of an "interference" or "plug" fit to couple the closure cap to the surrounding pour spout to form the closure unit and showing the use of a set of mating threads to couple the closure unit to the container neck finish along an interface between the container neck finish and the surrounding cap.

Closure cap 418 includes a cylindrical sleeve 470 extending downwardly from a top wall 471 and an outer shell 472 coupled to sleeve 470 and arranged to extend around sleeve 470 as suggested in FIGS. 21 and 25. Cylindrical sleeve 470 and top wall 471 cooperate to define a liquid-receiving region 479 for liquid-measuring purposes as shown in FIG. 24. Outer shell 472 includes annular side wall 473 and an annular top wall 474 arranged to interconnect annular side wall 473 and annular top wall 474.

In the illustrated embodiment, top wall 471 is round and cylindrical sleeve 470 includes an outer sleeve portion 470*a* extending between annular top wall 474 and round top wall 471 and an inner sleeve portion 470*b* extending in a downward direction from annular top wall 474 in an interior region bounded by annular side wall 473 of outer shell 472. Inner sleeve portion 470*b* extends into product-drainback reservoir 436 to surround discharge tube 428 when closure cap 418 is mounted on pour spout 416 as suggested in FIG. 25. Inner sleeve portion 470*b* also mates with, for example, several circumferentially spaced-apart cap-centering guide ribs 409 included in pour spout 416 and located in product-drainback reservoir 436 to establish a relatively loose interference fit between pour spout 416 and closure cap 418 and associated with preassembled closure unit 410 as suggested in FIG. 27.

Pour spout 416 includes an upright discharge tube 428 and a product drainback cup 496. Upright discharge tube 428 is coupled to a bottom wall 430 of product drainback cup 496 at a fluid-admission inlet 432. Product drainback cup 496 further includes an annular wall 434 coupled to a perimeter edge of bottom wall 430 to form a product-drainback reservoir 436 surrounding discharge tube 428. Radially inwardly extending "cap-centering" guide ribs 409 are coupled to an interior surface 434' of annular wall 434 as suggested in FIG. 23. As suggested in FIGS. 20, 23, and 25, discharge tube 428 is formed to include an inner portion 428' formed to include a fluid-admission inlet 432 arranged to open into an interior region of container 415 and an outer portion 428" formed to include fluid-discharge outlet 433. Annular wall 434 is formed to include a product-drainback aperture 438 communicating with reservoir 436 as shown in FIG. 23. Pour spout 416 is also formed to include a channel 417 providing a weir 419 shown in FIGS. 22 and 25 for managing liquid being poured.

Pour spout 416 includes a finish mount 445 comprising surface 434" of annular wall 434 of exterior pour spout 416 configured to mate with neck finish 414 as suggested in FIG. 25 to establish the relatively tighter second interference fit between pour spout 416 and container neck finish 414. In an illustrative embodiment, finish mount 445 is coupled to discharge tube 428 and comprises an annular rim 435 and a product drainback cup 496 made of annular wall 434 and bottom wall 430 as suggested in FIGS. 1, 23, 26, and 27. Drainback cup 496 has an outer edge coupled to rim 435 and an inner edge coupled to discharge tube 428 as suggested in FIG. 25. As suggested in FIGS. 22 and 25, closure unit 410 is moved downwardly toward mating engagement with underlying container neck finish 414 of container 415 to anchor pour spout 416 in a stationary, anchored position on container neck finish 414 by means of the relatively tight second interference fit between pour spout 416 and neck finish 414.

Figure 22:
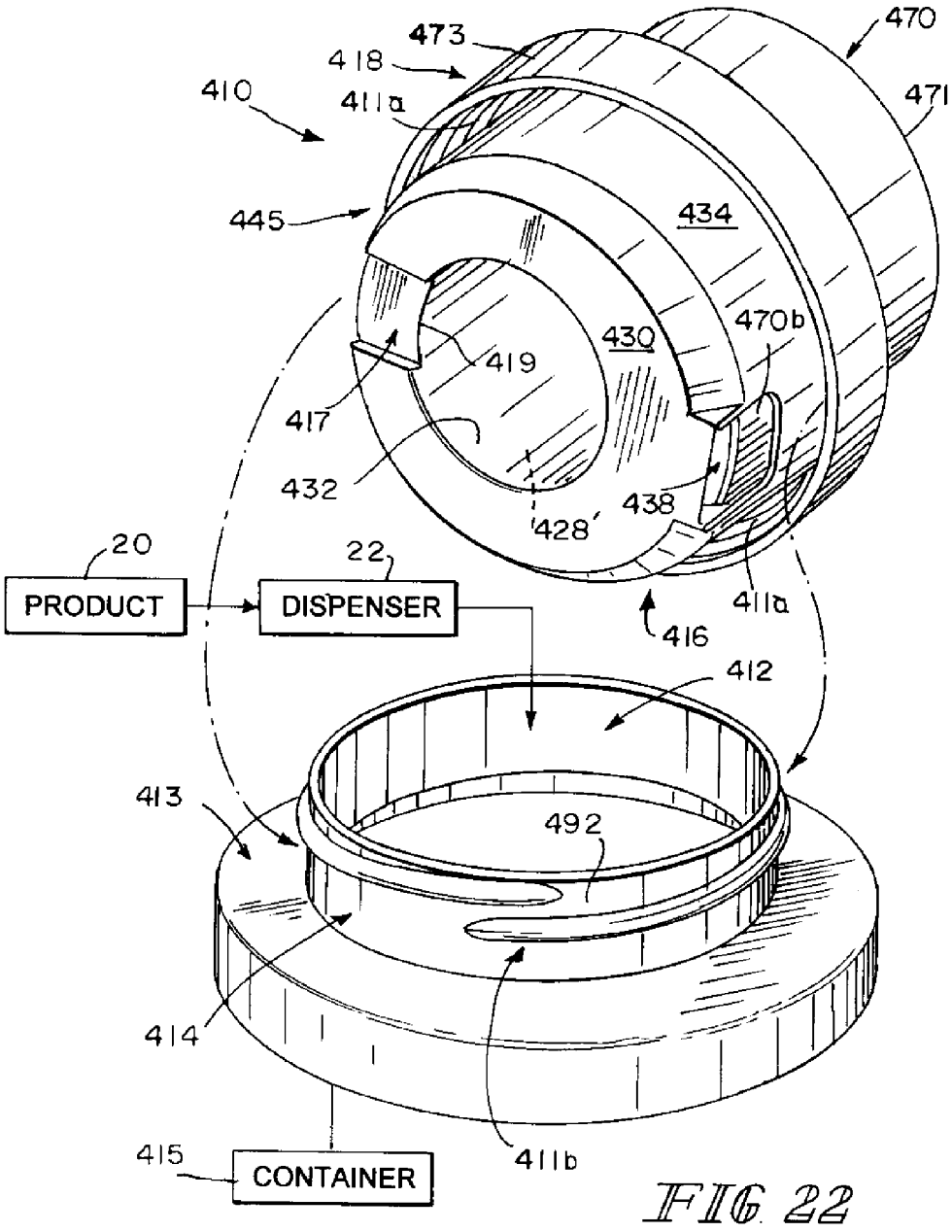
FIG. 22 is an enlarged perspective view showing a preassembled closure unit of the type shown in FIGS. 20 and 21 as it is being installed on the externally threaded neck finish of a container by a bottler after the container has been filled with liquid or other product discharged into the container through a "wide-mouth" opening provided in the container neck finish.
Figure 23:
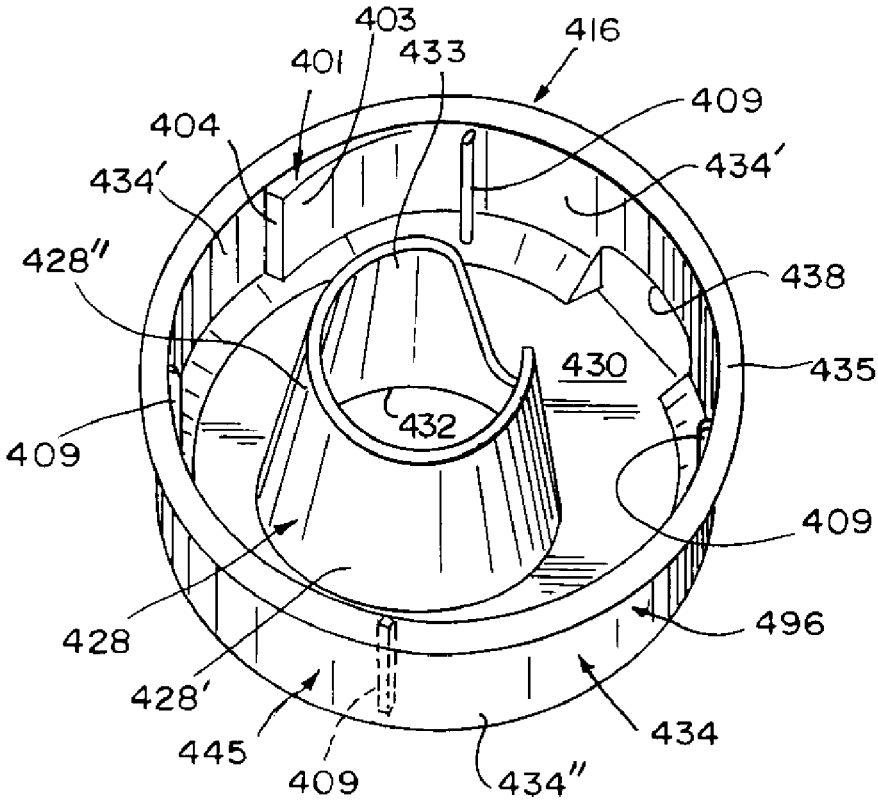
FIG. 23 is an enlarged perspective view of the pour spout of FIGS. 20-22 showing a driven lug including a ramp terminating at a stop wall provided on an interior side wall of the pour spout.

Preassembled closure unit 410 is shown in FIG. 22 as it is being installed on the externally threaded neck finish 414 of a container 415 by a bottler at a factory after container 415 has been filled with liquid or other product 20 discharged into container 415 through a "wide-mouth" opening 412 provided in container neck finish 414. An enlarged perspective view of pour spout 416 showing a driven lug 401 including a ramp 403 terminating at a stop wall 404 provided on an interior surface of annular wall 434 of pour spout 416 is shown in FIG. 23. An enlarged perspective view of the underside of closure cap 418 showing a drive lug 402 including a ramp 403 terminating at a stop wall 404 provided on an exterior surface of an inner sleeve 470*b* of closure cap 418 is shown in FIG. 24. Pour spout 416 is also formed to include a channel 417 providing a weir 419 shown in FIG. 22 for managing liquid being poured (as suggested in FIG. 6B). Lugs 401, 402 are arranged to mate during rotation of closure cap 418 relative to container neck finish 414 to transmit rotary motion from a rotating (about axis 23) closure cap 418 to pour spout 416 during mounting of preassembled closure unit 410 onto neck finish 414 and to establish a predetermined desired orientation of pour spout 416 relative to container neck finish 414 in the stationary, anchored position of pour spout 416 on container neck finish 414.

Use of a relatively loose interference (or plug) fit to couple closure cap 418 to the surrounding pour spout 416 to form closure unit 410 and use of a set of mating threads 411*a* and 411*b* to couple closure unit 418 to container neck finish 414 using an interlocking fit along an interface between container neck finish 414 and surrounding closure cap 418 is shown in FIG. 25. In the illustrated embodiment, an internal thread 411*a* provided on an interior surface of annular side wall 473 (as shown in FIGS. 22 and 24-27) mates with an external thread 411*b* provided on an exterior surface 492 of container neck finish 414.

Figure 26:
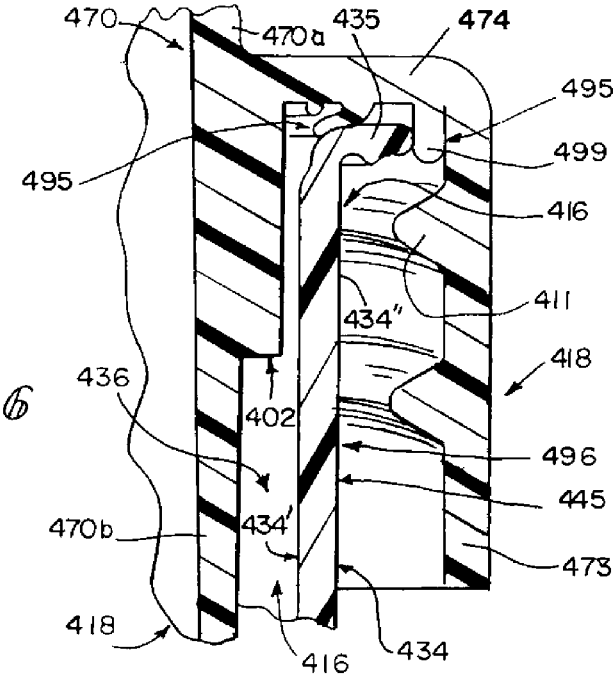
FIG. 26 is an enlarged sectional view of a portion of the closure unit shown in FIG. 25.
Figure 27:
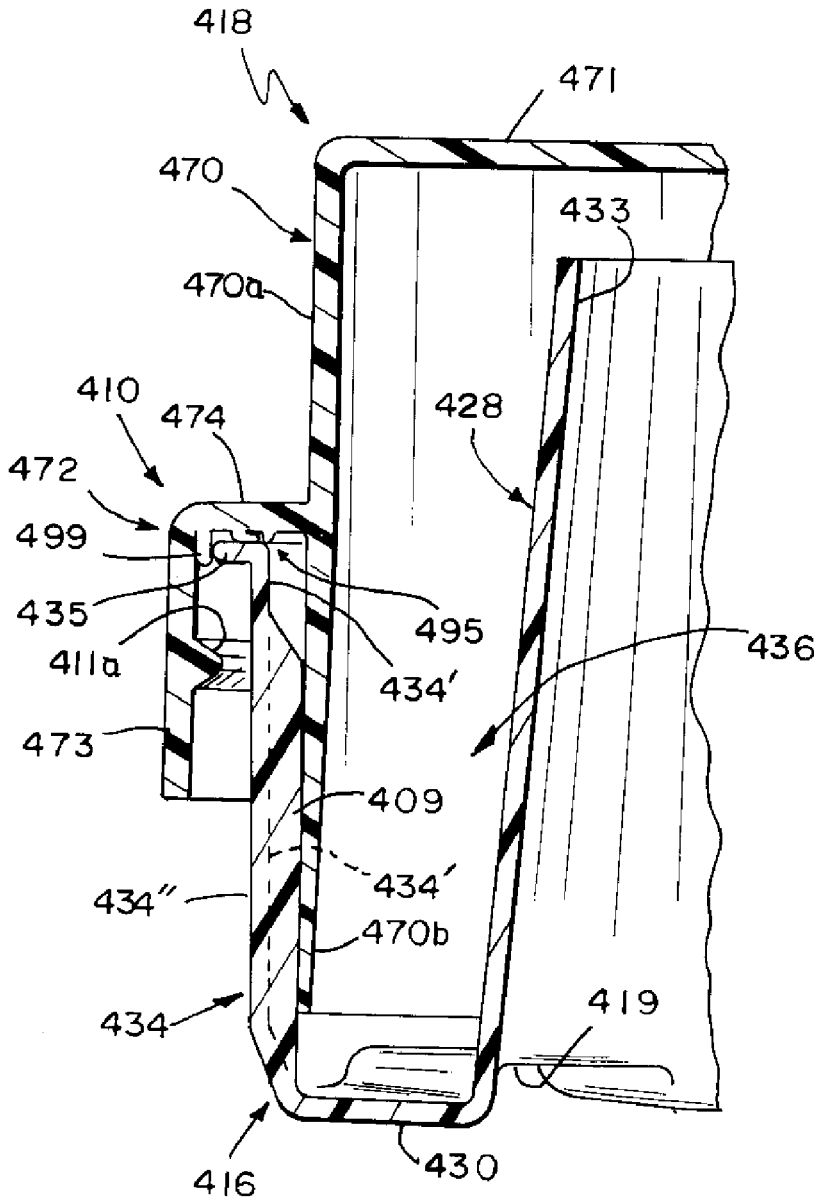
FIG. 27 is an enlarged sectional view of a portion of the closure unit showing contact between free edges of support ribs (see also FIG. 23) included in the pour spout and a sleeve of the cap.

Contact between radially inwardly facing free edges of cap-centering guide ribs 409 included in pour spout 416 and an inner sleeve portion 470*b* of sleeve 470 of closure cap 418 is shown in FIG. 27. Such contact helps to "center" closure cap 418 in a proper position relative to pour spout 416 when closure cap 418 is coupled to pour spout 416. An annular seal 495 is established between closure cap 418 and pour spout 416 as shown, for example, in FIGS. 25-27.

In closure unit 410 illustrated, for example, in FIGS. 20-27, a "snap-fit" connection is established between pour spout 416 and closure cap 418 to preassembled closure unit 410 and the preassembled closure unit 410 is screwed onto container neck finish 414. Thus, "down force" and "torque" must be supplied to mount closure unit 410 onto container neck finish 414 at the factory. In this process, pour spout 416 is retained in closure cap 418 until closure cap 418 is coupled to container neck finish 414. At this stage, "capping" of closure cap 418 on container neck finish 414 "relieves" retention of pour spout 416 in closure cap 418 and container neck finish 414 "pulls in" the outer diameter of pour spout 416 as shown, for example, in FIG. 25.

An annular retention bead 499 on the underside of annular top wall 474 of closure cap 418 mates with annular rim 435 of pour spout 416 as suggested in FIGS. 26 and 27 and cooperates with interlocking threads 411*a* and 411*b* to provide means for retaining closure cap 418 in coupled relation to pour spout 416 to establish preassembled closure unit 410. Annular retention bead 499 is configured to mate with rim 435 to help retain pour spout 416 in mated relation to closure cap 418 upon preassembly of pour spout 416 and closure cap 418 to define closure unit 410 as suggested in FIG. 26. Then, when closure cap 418 mates with neck finish 414 as preassembled closure unit 410 is mounted on neck finish 414, annular retention bead 499 is moved away from rim 435 so as to release its "retentive grip" on rim 435 of pour spout 416 now that pour spout 416 has moved to assume the stationary, anchored position in neck finish 414 to facilitate release of closure cap 418 from pour spout 416. Lugs 401, 402 mate as suggested in FIGS. 23-25 to orient pour spout 416 about axis 23 relative to closure cap 418. Single lead threads 411*a*, 411*b* cooperate to orient preassembled closure unit 410 relative to container neck finish 414.

A preassembled closure unit 510 in accordance with a fifth embodiment of the present disclosure is shown, for example, in FIGS. 28-37. In this embodiment, a positive stopping and locking feature is provided between pour spout 516 and closure cap 518 as suggested, for example, in FIG. 32 and also between pour spout 516 and container neck finish 514 as suggested, for example, in FIG. 34.

Figure 29:
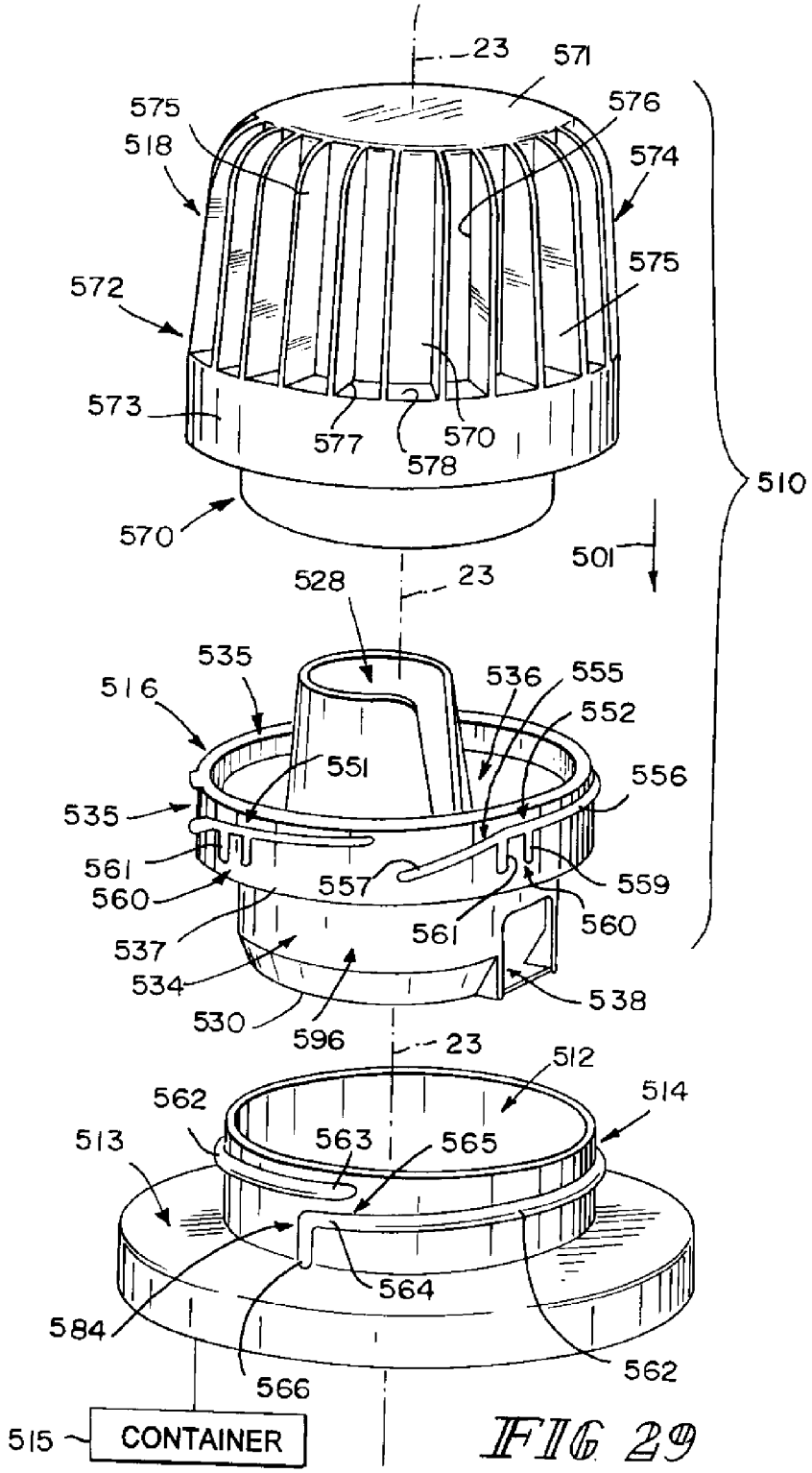
FIG. 29 is an exploded assembly view of the components illustrated in FIG. 28 showing a neck finish coupled to a container and a separate (unassembled) closure unit comprising a closure cap and a pour spout located between the neck finish and the closure cap.
Figure 30:
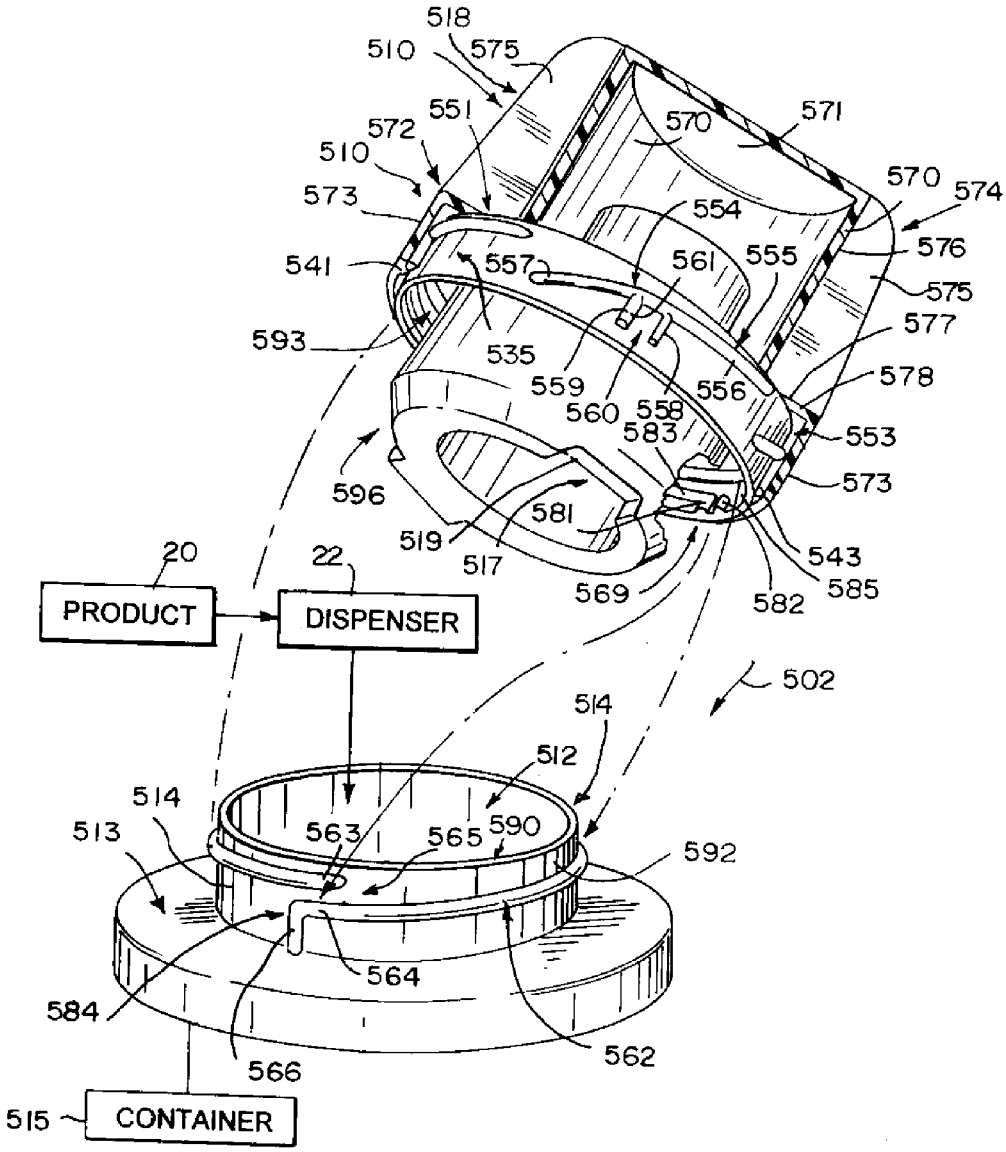
FIG. 30 is an enlarged perspective view showing a preassembled closure unit of the type shown in FIGS. 28 and 29 as it is being installed on the neck finish of a container by a bottler after the container has been filled with liquid or other product discharged into the container through a "wide-mouth" opening provided in the container neck finish.

Closure unit 510 includes pour spout 516 and closure cap 518 as suggested in FIG. 29 and, once preassembled, mounts in an opening 512 formed in a neck finish 514 coupled to a top wall 513 of a container 515 as suggested in FIG. 30. Each of cap lugs 541, 542, 543, and 544 provided on closure cap 518 mates with a companion one of the cap-lug lock managers 551, 552, 553, and 554 provided on pour spout 516 to mate closure cap 518 to pour spout 516 to establish preassembled closure unit 510 as suggested in FIGS. 31, 32, and 32A. As suggested in FIGS. 33 and 34, an anchor rib 566 provided on container neck finish 514 mates with a companion anchor rib receiver 569 provided on pour spout 516 in preassembled closure unit 510 to mate pour spout 516 to container neck finish 514 during factory installation of preassembled closure unit 510 on container neck finish 514.

As suggested in FIG. 30, a bottler first discharges product 20 into container 515 through opening 512 using a dispenser 22 and then, after container 515 is filled with product 20, the bottler installs preassembled closure unit 510 on neck finish 514 of container 515 at the factory to close opening 512 and anchor pour spout 516 to neck finish 514. Later, a consumer removes closure cap 518 (by separating closure cap 518 from pour spout 516) to expose pour spout 516 in a stationary, anchored position on neck finish 514 of container 515.

As suggested in FIGS. 29 and 31, closure cap 518 includes a cylindrical inner sleeve 570 extending downwardly from a top wall 571 and an outer shell 572 coupled to top wall 571 and arranged to extend around inner sleeve 570. Outer shell 572 includes an annular side wall 573 and an annular grip portion 574 arranged to interconnect annular side wall 573 and top wall 571. In the illustrated embodiment, top wall 571 is round and annular grip portion 574 includes a series of radially outwardly extending fins 575. An inner edge 576 of each fin 575 is appended to an exterior surface of inner sleeve 570 and a lower edge 577 of each fin 575 is coupled to a ring-shaped floor 578 interconnecting inner sleeve 570 and annular side wall 573 as shown, for example, in FIGS. 28-30.

Figure 33:
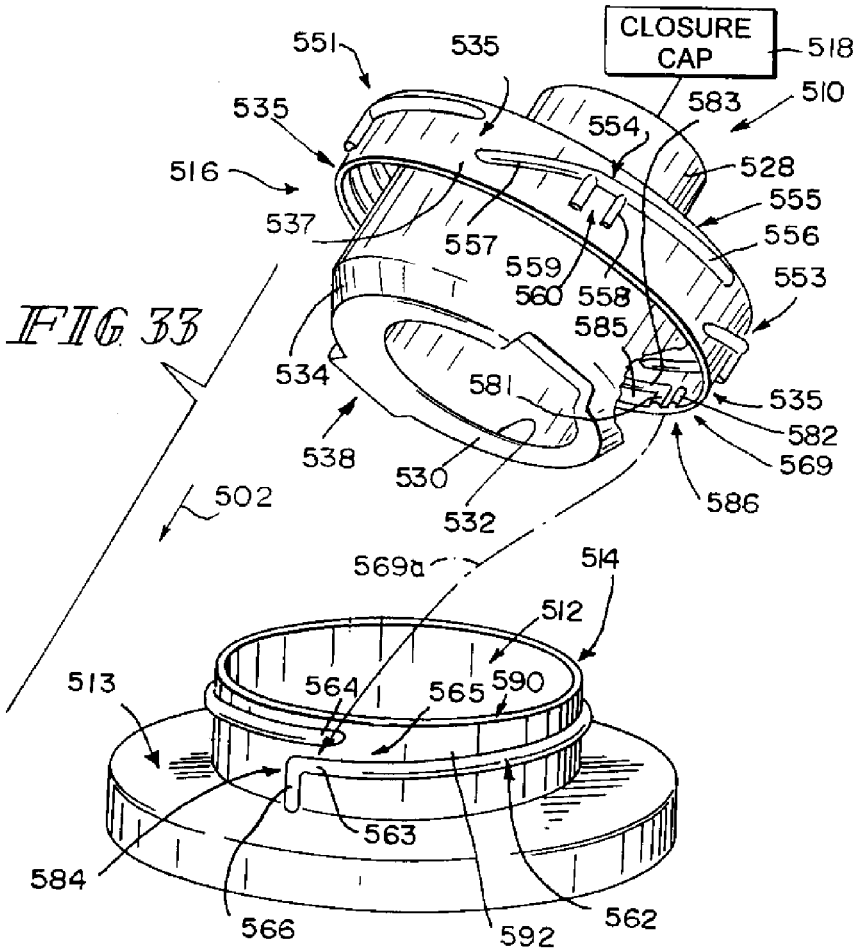
FIG. 33 is a perspective view similar to FIG. 30, with portions broken away, showing downward movement of the pour spout toward mating engagement with the underlying container neck finish during coupling of the closure unit (containing the pour spout) to the container neck finish and showing a pair of companion spout lugs arranged to lie in side-by-side relation to one another on an interior surface of the annular rim of the pour spout to define an anchor rib receiver therebetween and sized to mate with a raised anchor rib included in the container neck finish to block relative rotation between the pour spout and the container neck finish about the axis of rotation.

Pour spout 516 is illustrated, for example, in FIGS. 29 and 33 and includes an upright discharge tube 528 and a product drainback cup 596. Upright discharge tube 528 is coupled to a bottom wall 530 of product drainback cup 596 at a product-admission outlet 532. Product drainback cup 596 further includes an annular wall 534 coupled to a perimeter edge of bottom wall 530 to form a product-drainback reservoir 536 surrounding discharge tube 528. Annular wall 534 is formed to include a product-drainback aperture 538 communicating with reservoir 536 as shown, for example, in FIG. 29. Pour spout 516 is also formed to include a channel 517 providing a weir 519 shown in FIGS. 30, 31, and 32A exposed to liquid as it is poured to manage liquid flow as suggested in FIG. 6B.

Annular wall 534 of pour spout 516 includes an annular rim 535 having an exterior surface 537 as shown in FIGS. 29 and 32. Each of cap-lug lock managers 551, 552, 553, and 554 is coupled to exterior surface 537 of annular rim 535 as suggested in FIGS. 29, 32, and 33. Each of cap-lug lock managers 551, 552, 553, and 554 includes a "ramp-shaped" cap-lug guide rail 555 and two cap-lug retainer ribs 558 and 559 extending downwardly from cap-lug guide rail 555 as shown in FIGS. 29 and 32. Each cap-lug guide rail 555 includes a gradually sloping rail section 556 coupled to a steep inclined rail section 557 as shown best in FIG. 32. A first cap-lug retainer rib 558 is somewhat narrow and short while a second cap-lug retainer rib 559 is relatively wider and longer than rib 558 as shown, for example, in FIG. 32. Ribs 558, 559 are arranged to lie in spaced-apart relation to one another to define a cap-lug receiver 560 therebetween as shown in FIG. 32.

Figure 28:
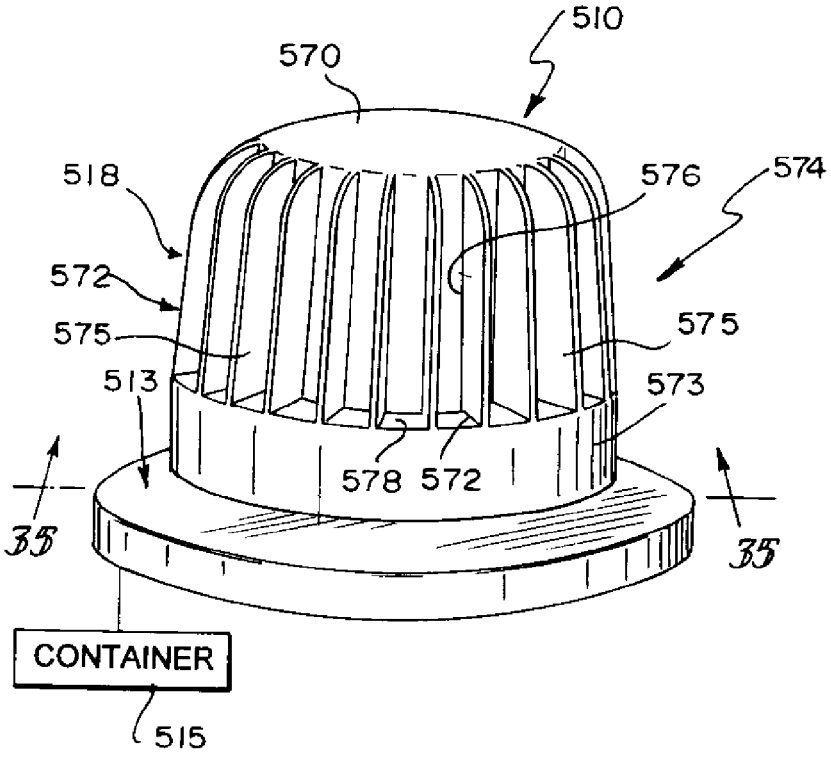
FIG. 28 is a perspective view of a closure unit in accordance with a fifth embodiment of the present disclosure coupled (for later removal) to a neck finish of a container.

Components comprising container 515 and closure unit 510 are shown, for example, in FIG. 28 after assembly and FIG. 29 before assembly. As suggested in FIGS. 31-32A, closure cap 518 is mated to pour spout 516 to form a preassembled closure unit 510. That closure unit 510 is then mated to container neck finish 514 on container 515 to close container mouth 512 as suggested in FIGS. 31, 33, and 34.

Downward movement in direction 501 of closure cap 518 toward mating engagement with underlying pour spout 516 is shown in FIG. 31. Four circumferentially spaced-apart cap lugs 541, 542, 543, and 544 are carried on an interior surface 599 of annular side wall 573 of closure cap 518 as suggested in FIG. 31. Each cap lug 541, 542, 543, and 544 will move along a separate "path" (e.g., 541*a*, 542*a*) to reach and mate with one of cap-lug lock managers 551, 552, 553, and 554 included in pour spout 516 when closure cap 518 is mated to pour spout 516 to establish preassembled closure unit 510 as suggested in FIGS. 31, 32, and 32A.

A "flat development" of annular rim 535 included in pour spout 516 is illustrated in FIG. 32. A series of four spaced-apart cap-lug lock managers 551, 552, 553, and 554 are provided on exterior surface 537 of annular rim 535. Each cap-lug lock manager 551, 552, 553, and 554 is configured to include a ramp-shaped cap-lug guide rail 555 and two cap-lug retainer ribs 558, 559 as suggested in FIG. 32. Cap lug 541 moves along dotted line path 541*a* when closure cap 518 is mated with pour spout 516. For example, as shown in FIG. 32, cap lug 541 moves first to a "right-side" position (shown in phantom) on steep inclined rail section 557 of cap-lug guide rail 555 of fourth cap-lug lock manager 554, moves second to a "middle" position (shown in solid) under gradually sloping rail section 556 of first cap-lug lock manager 551, and moves third to a "left-side" position (shown in phantom) engaging a stop face 561 on retainer rib 559 to lie in a "trapped" position in a cap-lug receiver 560 defined between cap-lug retainer ribs 558, 559.

Figure 34:
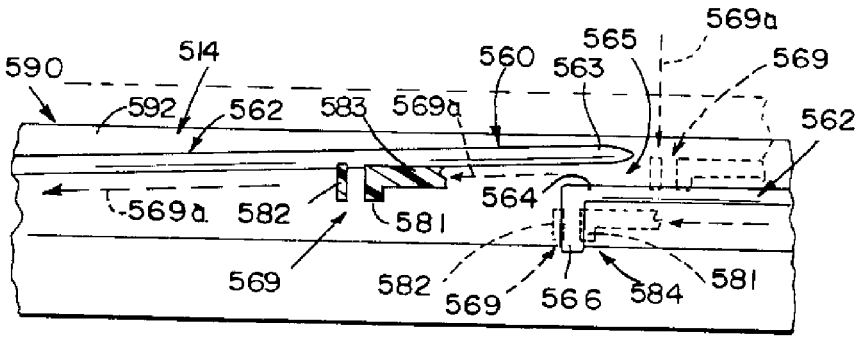
FIG. 34 is an enlarged "flat development" of an annular side wall included in the container neck finish showing a spout lug guide including an inclined lug ramp and an anchor rib underlying a low end of the inclined lug ramp on an exterior surface of the annular side wall of the container neck finish and a pair of side-by-side spout lugs carried on the interior surface of the annular rim of the pour spout and showing a "dotted-line" path along which the spout lugs move relative to the spout lug guide included in the container neck finish to assume a stopped position mating with the anchor rib of the spout lug guide.
Figure 35:
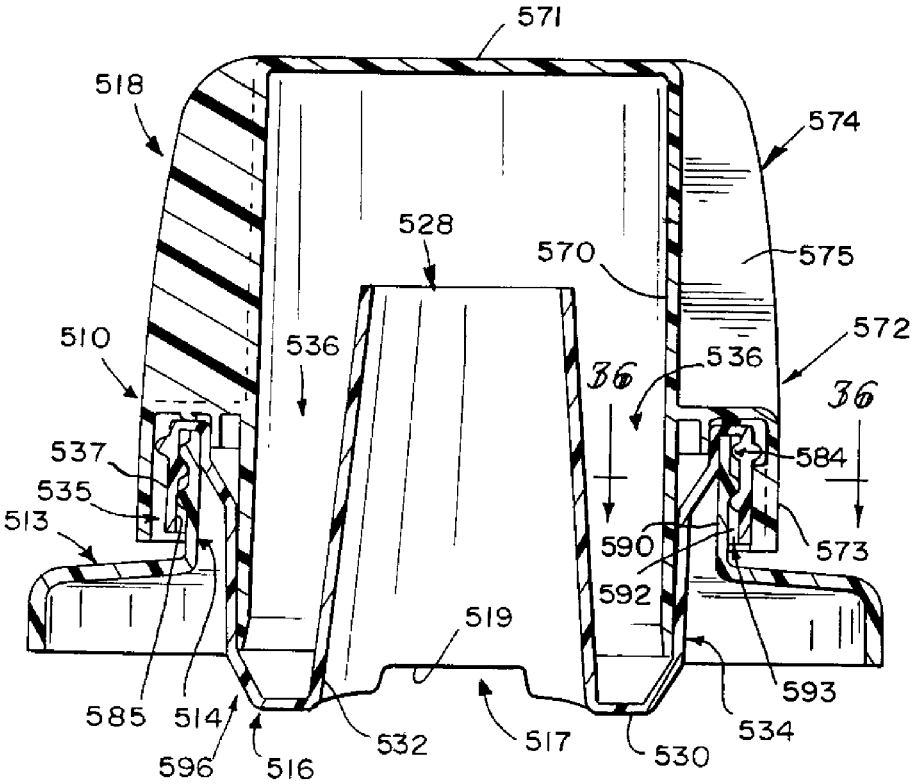
FIG. 35 is an enlarged sectional view taken along line 35-35 of FIG. 28.
Figure 36:
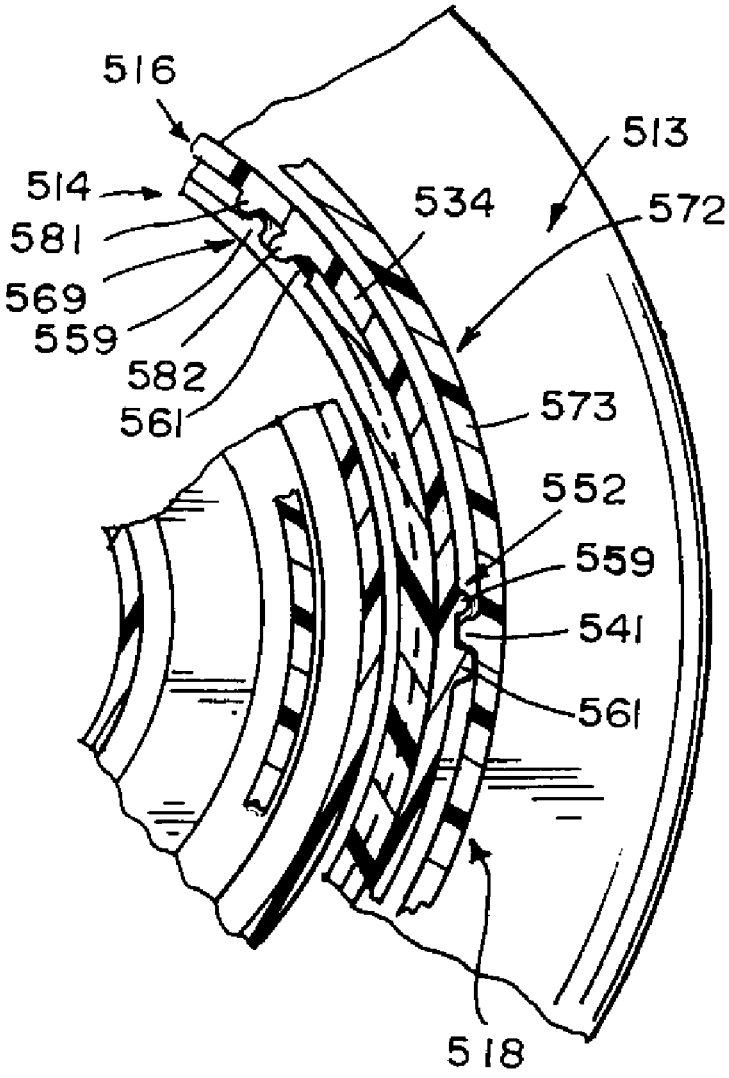
FIG. 36 is an enlarged sectional view taken along line 36-36 of FIG. 35.
Figure 37:
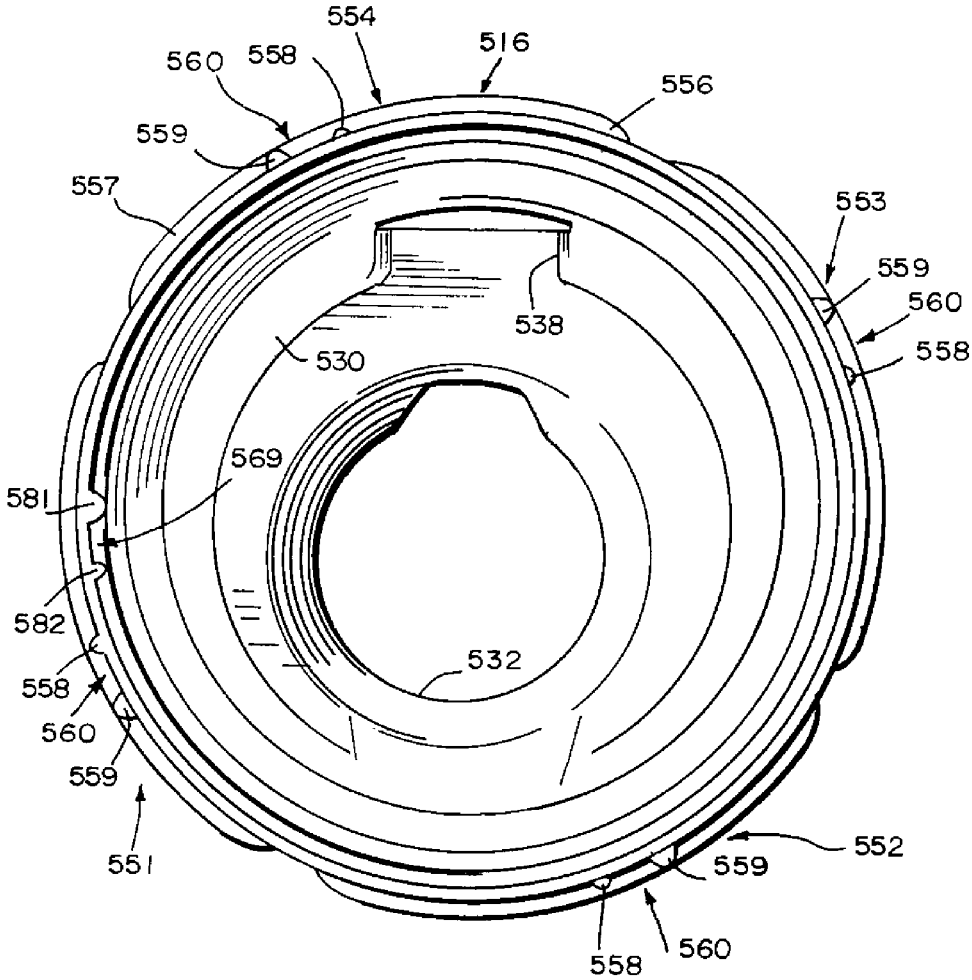
FIG. 37 is an enlarged bottom view of the pour spout shown in FIG. 33 showing four circumferentially spaced-apart pairs of side-by-side spout lugs.

As suggested in FIGS. 30, 33, and 34, preassembled closure unit 510 is moved downwardly in direction 502 toward mating engagement with underlying container neck finish 514 of container 515 to anchor pour spout 516 in a stationary, anchored position on container neck finish 514. As suggested in FIG. 33, a spout catch 586 included in pour spout 516 is configured to mate with a spout catch receiver 584 included in neck finish 514 to anchor pour spout 516 on neck finish 514 as shown in FIG. 35. In an illustrative embodiment, spout catch 586 is provided on interior surface 585 of annular rim 535 of pour spout 516 and spout catch receiver 584 is provided on exterior surface 592 of annular side wall 590 of neck finish 514.

Pour spout 516 includes a finish mount 545 configured to mate with neck finish 514. In an illustrative embodiment, finish mount 545 is coupled to discharge tube 528 and comprises annular rim 535, a spout catch 586 provided on rim 535, and a product drainback cup 596 made of annular wall 534 and bottom wall 530. Spout catch 586 of finish mount 545 is configured to mate with spout catch retainer 584 in neck finish 514 as suggested in FIGS. 30 and 35 to anchor pour spout 516 in a stationary, anchored position on container neck finish 514. Drainback cup 596 has an outer edge coupled to rim 535 and an inner edge coupled to discharge tube 528. Rim 535 is formed to include a downwardly opening annular channel 593 receiving neck finish 514 therein as suggested in FIGS. 30 and 35.

Spout catch 586 of pour spout 516 includes a pair of companion first and second spout lugs 581, 582 that are arranged to lie in side-by-side relation to one another on an interior surface 585 of annular rim 535 of pour spout 516 to define an anchor rib receiver 569 therebetween as shown, for example, in FIGS. 30, 33, and 34. A helical spout flange 583 also included in spout catch 586 is coupled to first spout lug 581 and arranged to extend away from second spout lug 582 and wind along interior surface 585 of annular rim 535 as suggested in FIGS. 30 and 33. These spout lugs 581, 582 are sized to mate with a raised anchor rib 566 included in a spout catch retainer 584 included in container neck finish 514 when pour spout 516 is mated with container neck finish 514 to block further rotation of pour spout 516 (and the rest of closure unit 510) relative to container neck finish 514 about axis 23.

Spout lug catch receiver 584 of neck-finish 514 includes raised anchor rib 566 and also includes an inclined lug guide ramp 562 (defined in the illustrated embodiment by a helical thread). Inclined lug guide ramp 562 is coupled to an upper end of anchor rib 566 and arranged to wind around container neck finish 514 as suggested in FIG. 33. Inclined lug guide ramp 562 includes a lower end 563 coupled to anchor rib 566 and an upper end 564 arranged to lie above and in spaced-apart relation to lower end 563 as suggested in FIGS. 33 and 34 to define a lug-receiving channel 565 therebetween. Rib receiver 569 (comprising spout lugs 581, 582) moves along dotted line path 569*a* as suggested in FIGS. 33 and 34 relative to inclined lug guide ramp 562.

A "flat development" of an annular side wall 590 included in container neck finish 514 is shown in FIG. 34. Spout catch retainer 584 is appended to an exterior surface 592 of annular side wall 590. Spout catch retainer 584 includes inclined lug guide ramp 562 and raised anchor rib 566. A dotted-line path 569*a* is shown in FIG. 34 along which spout lugs 581, 582 move relative to spout catch retainer 584 to assume a stopped position mating with anchor rib 566 of spout catch retainer 584 to block further rotation of pour spout 516 and closure unit 510 relative to container neck finish 514 about axis 23. This installation of closure unit 510 on container neck finish 514 takes place at a factory after container 515 is filled with a fluid material such as a liquid or granular or other product (not shown).

When a consumer later removes closure cap 518 to access product stored in container 515, pour spout 516 will remain in a stationary, anchored position on container neck finish 514. Rotation of closure cap 518 in a counterclockwise cap-removal direction is sufficient to "overcome" resistance to disengagement of cap lugs 541, 542, 543, and 544 on closure cap 518 relative to cap-lug retainer ribs 558, 559 in cap-lug lock managers 551, 552, 553, and 554 on pour spout 516 without overcoming resistance to disengagement of anchor rib 566 on container neck finish 514 relative to spout lugs 581, 582 on pour spout 516. Closure cap 518 can be removed and remounted on pour spout 516 without disrupting the stationary, anchored position of pour spout 516 on container neck finish 514.

The invention claimed is:

1. A package comprising a container neck finish formed to include a wide-mouth opening and adapted to mate with a container formed to include an interior region to place the wide-mouth opening in communication with the interior region, and a preassembled closure unit configured to mate with the container neck finish to close the wide-mouth opening into the interior region of the container, the preassembled closure unit including a pour spout having a fluid-discharge outlet and a closure cap configured to mate with the pour spout to cover the fluid-discharge outlet and separate from the pour spout while the pour spout is mated with the container neck finish to expose the fluid-discharge outlet, wherein the closure cap includes a top wall, a cylindrical sleeve extending downwardly from the top wall and cooperating with the top wall to form a liquid-receiving region, and an outer shell coupled to the cylindrical sleeve and arranged to extend around the cylindrical sleeve and mate with the container neck finish to retain the closure cap on the container neck finish, wherein the cylindrical sleeve includes an outer sleeve portion extending from the outer shell to the top wall and an inner sleeve portion extending from the outer sleeve portion in a downward direction away from the top wall, wherein the pour spout includes a product drainback cup and a discharge tube coupled to the product drainback cup, the discharge tube having an inner portion formed to include a fluid-admission inlet arranged to open into the interior region of a container mated with the container neck finish and an outer portion formed to include the fluid-discharge outlet, the product drainback cup providing first interference-fit means for establishing an interference fit between the pour spout and the container neck finish to retain the pour spout in a stationary, anchored position on the container neck finish to place the fluid-admission inlet formed in the discharge tube in communication with the interior region of a container mated to the container neck finish when the preassembled closure unit is first mated with the container neck finish to close the wide-mouth opening into the interior region of the container and during later movement of the closure cap between a capped position covering the fluid-discharge outlet of the discharge tube and an uncapped position uncovering the fluid-discharge outlet of the discharge tube, and wherein the pour spout further includes at least two circumferentially spaced apart cap-centering guide ribs coupled to the product drainback cup and located in a product-drainback reservoir formed in the product drainback cup, the cap-centering guide ribs cooperating with the inner sleeve portion of the closure cap to provide second interference-fit means for establishing an interference fit between the pour spout and the closure cap that is relatively loose as compared to the interference fit established between the pour spout and the container neck finish so that the relatively loose interference fit established by the second interference-fit means will be broken to allow separation of the closure cap from the pour spout without disrupting or otherwise breaking the relatively tighter interference fit established between the pour spout and the container neck finish by the first interference-fit means.

2. The package of claim 1, wherein the product drainback cup includes a bottom wall and an annular wall coupled to the bottom wall to form the product-drainback reservoir and the cap-centering guide ribs are coupled to an interior surface of the annular wall.

3. The package of claim 2, wherein each cap-centering guide rib is an elongated member having a lower end arranged to lie near the bottom wall of the product drainback cup and an upper end arranged to lie near a top edge of the annular wall that is arranged to lie above and in spaced-apart relation to the bottom wall.

4. The package of claim 2, wherein a first and a second of the cap-centering guide ribs is arranged to lie in spaced-apart relation to one another to locate the discharge tube therebetween.

5. The package of claim 4, wherein each cap-centering guide rib is an elongated member having a lower end arranged to lie near the bottom wall of the product drainback cup and an upper end arranged to lie near a top edge of the annular wall that is arranged to lie above and in spaced-apart relation to the bottom wall.

6. The package of claim 2, wherein the closure cap further includes a drive lug coupled to an exterior surface of the inner sleeve portion of the cylindrical sleeve, and the pour spout further includes a driven lug coupled to the interior surface of the annular wall and arranged to be engaged by the drive lug of the closure cap during rotation of the closure cap relative to the container neck finish to transmit rotary motion about a vertical axis from a rotating closure cap to the pour spout during mounting of the preassembled closure unit onto the container neck finish and to establish a predetermined orientation of the pour spout relative to the container neck finish in the stationary, anchored position of the pour spout on the container neck finish.

7. The package of claim 6, wherein a first and a second of the cap-centering guide ribs are coupled to the interior surface of the annular wall to define a first surface section therebetween and the driven lug is coupled to the first surface section to lie in circumferentially spaced-apart relation to each of the first and second cap-centering guide ribs.

8. The package of claim 6, wherein the driven lug includes a ramp terminating at a stop wall provided on the interior surface of the annular wall of the pour spout, the drive lug includes a ramp terminating at a stop wall provided on an exterior surface of the inner sleeve portion of the cylindrical sleeve, and the stop walls of the driven and drive lugs mate upon arrival of the pour spout in the stationary, anchored position of the pour spout on the container neck finish.

9. The package of claim 1, wherein the product drainback cup includes a bottom wall and an annular wall coupled to the bottom wall to form the product-drainback reservoir and arranged to surround and lie in spaced-apart relation to the inner sleeve portion of the cylindrical sleeve.

10. A package comprising a container neck finish formed to include a wide-mouth opening and adapted to mate with a container formed to include an interior region to place the wide-mouth opening in communication with the interior region, and a preassembled closure unit configured to mate with the container neck finish to close the wide-mouth opening into the interior region of the container, the preassembled closure unit including a pour spout having a fluid-discharge outlet and a closure cap configured to mate with the pour spout to cover the fluid-discharge outlet and separate from the pour spout while the pour spout is mated with the container neck finish to expose the fluid-discharge outlet, wherein the closure cap includes a top wall, a cylindrical sleeve extending downwardly from the top wall and cooperating with the top wall to form a liquid-receiving region, and an outer shell coupled to the cylindrical sleeve and arranged to extend around the cylindrical sleeve and mate with the container neck finish to retain the closure cap on the container neck finish, wherein the cylindrical sleeve includes an outer sleeve portion extending from the outer shell to the top wall and an inner sleeve portion extending from the outer sleeve portion in a downward direction away from the top wall, wherein the pour spout includes a product drainback cup and a discharge tube coupled to the product drainback cup, the discharge tube having an inner portion formed to include a fluid-admission inlet arranged to open into the interior region of a container mated with the container neck finish and an outer portion formed to include the fluid-discharge outlet, the product drainback cup providing first interference-fit means for establishing an interference fit between the pour spout and the container neck finish to retain the pour spout in a stationary, anchored position on the container neck finish to place the fluid-admission inlet formed in the discharge tube in communication with the interior region of a container mated to the container neck finish when the preassembled closure unit is first mated with the container neck finish to close the wide-mouth opening into the interior region of the container and during later movement of the closure cap between a capped position covering the fluid-discharge outlet of the discharge tube and an uncapped position uncovering the fluid-discharge outlet of the discharge tube, wherein the pour spout further includes at least two cap-centering guide ribs coupled to the product drainback cup and located in a product-drainback reservoir formed in the product drainback cup, the cap-centering guide ribs cooperating with the inner sleeve portion of the closure cap to provide second interference-fit means for establishing an interference fit between the pour spout and the closure cap that is relatively loose as compared to the interference fit established between the pour spout and the container neck finish so that the relatively loose interference fit established by the second interference-fit means will be broken to allow separation of the closure cap from the pour spout without disrupting or otherwise breaking the relatively tighter interference fit established between the pour spout and the container neck finish by the first interference-fit means, and wherein the product drainback cup includes a bottom wall, an annular wall coupled to the bottom wall to form the product drainback-reservoir, and a rim coupled to the annular wall and arranged to lie in spaced-apart relation to the bottom wall and extend radially outwardly away from the discharge tube, the outer shell of the closure cap includes an annular side wall arranged to surround the annular wall of the product drainback cup and an annular top wall arranged to interconnect the cylindrical sleeve and the annular side wall, the rim of the product drainback cup includes a radially outwardly facing edge facing toward an interior surface of the annular side wall of the outer shell and an axially upwardly facing surface facing toward an underside of the annular top wall of the outer shell, and the outer shell is arranged to mate with the radially outwardly facing edge of the rim of the product drainback cup to provide temporary retention means for establishing temporarily a retentive grip on the pour spout in mated relation to the closure cap upon preassembly of the pour spout and the closure cap to define the closure unit and for releasing the retentive grip on the pour spout once the pour spout is moved to assume the stationary, anchored position on the container neck finish so as to facilitate release of the closure cap from the pour spout.

11. The package of claim 10, wherein the temporary retention means includes an annular retention bead coupled to the underside of the annular top wall of the outer shell and arranged to lie between the radially outwardly facing edge of the rim and the interior surface of the annular side wall of the outer shell.

12. The package of claim 11, wherein the outer shell further includes an annular seal coupled to the underside of the annular top wall of the outer shell and arranged to engage the axially upwardly facing surface of the rim.

13. The package of claim 12, wherein the container neck finish and the annular top wall of the outer shell cooperate to form a seal-receiving space therebetween upon movement of the pour spout to the stationary, anchored position on the container neck finish and the annular seal is arranged to lie in the seal-receiving space above the container neck finish.

14. The package of claim 10, wherein the rim is arranged to lie in a space provided between a first of the cap-centering guide ribs and the interior surface of the annular side wall of the outer shell.

15. A package comprising a container neck finish formed to include a wide-mouth opening and adapted to mate with a container formed to include an interior region to place the wide-mouth opening in communication with the interior region, and a preassembled closure unit configured to mate with the container neck finish to close the wide-mouth opening into the interior region of the container, the preassembled closure unit including a pour spout having a fluid-discharge outlet and a closure cap configured to mate with the pour spout to cover the fluid-discharge outlet and separate from the pour spout while the pour spout is mated with the container neck finish to expose the fluid-discharge outlet, wherein the closure cap includes a top wall, a cylindrical sleeve extending downwardly from the top wall and cooperating with the top wall to form a liquid-receiving region, and an outer shell coupled to the cylindrical sleeve and arranged to extend around the cylindrical sleeve and mate with the container neck finish to retain the closure cap on the container neck finish, wherein the cylindrical sleeve includes an outer sleeve portion extending from the outer shell to the top wall and an inner sleeve portion extending from the outer sleeve portion in a downward direction away from the top wall, wherein the pour spout includes a product drainback cup and a discharge tube coupled to the product drainback cup, the discharge tube having an inner portion formed to include a fluid-admission inlet arranged to open into the interior region of a container mated with the container neck finish and an outer portion formed to include the fluid-discharge outlet, the product drainback cup providing first interference-fit means for establishing an interference fit between the pour spout and the container neck finish to retain the pour spout in a stationary, anchored position on the container neck finish to place the fluid-admission inlet formed in the discharge tube in communication with the interior region of a container mated to the container neck finish when the preassembled closure unit is first mated with the container neck finish to close the wide-mouth opening into the interior region of the container and during later movement of the closure cap between a capped position covering the fluid-discharge outlet of the discharge tube and an uncapped position uncovering the fluid-discharge outlet of the discharge tube, and wherein the pour spout further includes a second interference-fit means for establishing an interference fit between the pour spout and the closure cap that is relatively loose as compared to the interference fit established between the pour spout and the container neck finish so that the relatively loose interference fit established by the second interference-fit means will be broken to allow separation of the closure cap from the pour spout without disrupting or otherwise breaking the relatively tighter interference fit established between the pour spout and the container neck finish by the first interference-fit means, and wherein the product drainback cup includes a bottom wall, an annular wall coupled to the bottom wall to form the product drainback-reservoir, and a rim coupled to the annular wall and arranged to lie in spaced-apart relation to the bottom wall and extend radially outwardly away from the discharge tube, the outer shell of the closure cap includes an annular side wall arranged to surround the annular wall of the product drainback cup and an annular top wall arranged to interconnect the cylindrical sleeve and the annular side wall, the rim of the product drainback cup includes a radially outwardly facing edge facing toward an interior surface of the annular side wall of the outer shell and an axially upwardly facing surface facing toward an underside of the annular top wall of the outer shell, and the outer shell is arranged to mate with the radially outwardly facing edge of the rim of the product drainback cup to provide temporary retention means for establishing temporarily a retentive grip on the pour spout in mated relation to the closure cap upon preassembly of the pour spout and the closure cap to define the closure unit and for releasing the retentive grip on the pour spout once the pour spout is moved to assume the stationary, anchored position on the container neck finish so as to facilitate release of the closure cap from the pour spout.

* * * * *